US006758277B2

(12) United States Patent
Vinegar et al.

(10) Patent No.: US 6,758,277 B2
(45) Date of Patent: Jul. 6, 2004

(54) SYSTEM AND METHOD FOR FLUID FLOW OPTIMIZATION

(75) Inventors: Harold J. Vinegar, Houston, TX (US); Robert Rex Burnett, Katy, TX (US); William Mountjoy Savage, Houston, TX (US); Frederick Gordon Carl, Jr., Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/768,656

(22) Filed: Jan. 24, 2001

(65) Prior Publication Data

US 2002/0029883 A1 Mar. 14, 2002

Related U.S. Application Data

(60) Provisional application No. 60/186,531, filed on Mar. 2, 2000, provisional application No. 60/186,527, filed on Mar. 2, 2000, provisional application No. 60/186,505, filed on Mar. 2, 2000, provisional application No. 60/186,504, filed on Mar. 2, 2000, provisional application No. 60/186,503, filed on Mar. 2, 2000, provisional application No. 60/186,394, filed on Mar. 2, 2000, provisional application No. 60/186,393, filed on Mar. 2, 2000, provisional application No. 60/186,382, filed on Mar. 2, 2000, provisional application No. 60/186,381, filed on Mar. 2, 2000, provisional application No. 60/186,380, filed on Mar. 2, 2000, provisional application No. 60/186,379, filed on Mar. 2, 2000, provisional application No. 60/186,378, filed on Mar. 2, 2000, provisional application No. 60/186,377, filed on Mar. 2, 2000, provisional application No. 60/186,376, filed on Mar. 2, 2000, provisional application No. 60/181,322, filed on Feb. 9, 2000, provisional application No. 60/178,001, filed on Jan. 24, 2000, provisional application No. 60/178,000, filed on Jan. 24, 2000, provisional application No. 60/177,999, filed on Jan. 24, 2000, provisional application No. 60/177,998, filed on Jan. 24, 2000, provisional application No. 60/177,997, filed on Jan. 24, 2000, and provisional application No. 60/177,883, filed on Jan. 24, 2000.

(51) Int. Cl.[7] ..... E21B 43/12

(52) U.S. Cl. ..... 166/372; 166/250.03; 166/250.15

(58) Field of Search ..... 166/250.15, 250.03, 166/372, 53, 369

(56) References Cited

U.S. PATENT DOCUMENTS 525,663 A 9/1894 Mottinger
2,917,004 A 12/1959 Davis et al.

(List continued on next page.)

FOREIGN PATENT DOCUMENTS

EP 28296 5/1981 ..... E21B/47/12

(List continued on next page.)

OTHER PUBLICATIONS

Brown, Connolizo and Robertson, West Texas Oil Lifting Short Course and H. W. Winkler, "Misunderstood or overlooked Gas–Lift Design and Equipment Considerations," SPE, p. 351 (1994).

(List continued on next page.)

*Primary Examiner*—David Bagnell
*Assistant Examiner*—Daniel P Stephenson

(57) ABSTRACT

A controllable gas-lift well having controllable gas-lift valves and sensors for detecting flow regime is provided. The well uses production tubing and casing to communicate with and power the controllable valve from the surface. A signal impedance apparatus in the form of induction chokes at the surface and downhole electrically isolate the tubing from the casing. A high band-width, adaptable spread spectrum communication system is used to communicate between the controllable valve and the surface. Sensors, such as pressure, temperature, and acoustic sensors, may be provided downhole to more accurately assess downhole conditions and in particular, the flow regime of the fluid within the tubing. Operating conditions, such as gas injection rate, back pressure on the tubing, and position of downhole controllable valves are varied depending on flow regime, downhole conditions, oil production, gas usage and availability, to optimize production. An Artificial Neural Network (ANN) is trained to detect a Taylor flow regime using downhole acoustic sensors, plus other sensors as desired. The detection and control system and method thereof is useful in many applications involving multi-phase flow in a conduit.

36 Claims, 9 Drawing Sheets

U.S. PATENT DOCUMENTS

| | | | | |
|---|---|---|---|---|
| 3,083,771 | A | 4/1963 | Chapman | |
| 3,247,904 | A | 4/1966 | Wakefield, Jr. | |
| 3,427,989 | A | 2/1969 | Bostock et al. | |
| 3,566,963 | A | 3/1971 | Blackledge | 166/189 |
| 3,602,305 | A | 8/1971 | Kisling, III | 116/134 |
| 3,732,728 | A | 5/1973 | Fitzpatrick | 73/151 |
| 3,793,632 | A | 2/1974 | Still | 340/18 |
| 3,814,545 | A | 6/1974 | Waters | 417/90 |
| 3,837,618 | A | 9/1974 | Juhel | 251/129 |
| 3,980,826 | A | 9/1976 | Widmer | 178/68 |
| 4,068,717 | A | 1/1978 | Needham | 166/272 |
| 4,087,781 | A | 5/1978 | Grossi et al. | 340/18 |
| 4,295,795 | A | 10/1981 | Gass et al. | 417/111 |
| 4,393,485 | A | 7/1983 | Redden | 367/25 |
| 4,468,665 | A | 8/1984 | Thawley et al. | 340/856 |
| 4,545,731 | A | 10/1985 | Canalizo et al. | 417/86 |
| 4,576,231 | A | 3/1986 | Dowling et al. | 166/248 |
| 4,578,675 | A | 3/1986 | MacLeod | 340/855 |
| 4,596,516 | A | 6/1986 | Scott et al. | 417/58 |
| 4,630,243 | A | 12/1986 | MacLeod | 367/82 |
| 4,648,471 | A | 3/1987 | Bordon | 175/4.55 |
| 4,662,437 | A | 5/1987 | Renfro | 166/65.1 |
| 4,681,164 | A | 7/1987 | Stacks | 166/304 |
| 4,709,234 | A | 11/1987 | Forehand et al. | 340/856 |
| 4,738,313 | A | 4/1988 | McKee | 166/372 |
| 4,739,325 | A | 4/1988 | MacLeod | 340/854 |
| 4,839,644 | A | 6/1989 | Safinya et al. | 340/854 |
| 4,886,114 | A | 12/1989 | Perkins et al. | 166/65.1 |
| 4,901,069 | A | 2/1990 | Veneruso | 340/853 |
| 4,972,704 | A | 11/1990 | Wellington et al. | 73/155 |
| 4,981,173 | A | 1/1991 | Perkins et al. | 166/66.4 |
| 5,001,675 | A | 3/1991 | Woodward | 367/13 |
| 5,008,664 | A | 4/1991 | More et al. | 340/854 |
| 5,034,371 | A | 7/1991 | Tanaka et al. | 503/227 |
| 5,130,706 | A | 7/1992 | Van Steenwyk | 340/854.6 |
| 5,134,285 | A | 7/1992 | Perry et al. | 250/269 |
| 5,160,925 | A | 11/1992 | Dailey et al. | 340/853.3 |
| 5,162,740 | A | 11/1992 | Jewell | 324/347 |
| 5,172,717 | A | 12/1992 | Boyle et al. | 137/155 |
| 5,176,164 | A | 1/1993 | Boyle | 137/155 |
| 5,191,326 | A | 3/1993 | Montgomery | 340/855.5 |
| 5,230,383 | A | 7/1993 | Pringle et al. | 166/66.4 |
| 5,246,860 | A | 9/1993 | Hutchins et al. | 436/27 |
| 5,251,328 | A | 10/1993 | Shaw | 455/73 |
| 5,257,663 | A | 11/1993 | Pringle et al. | 166/66.4 |
| 5,267,469 | A | 12/1993 | Espinoza | 73/40.5 |
| 5,278,578 | A | 1/1994 | Baek et al. | 346/76 L |
| 5,331,318 | A | 7/1994 | Montgomery | 340/855.4 |
| 5,353,627 | A | 10/1994 | Diatschenko et al. | 73/19.03 |
| 5,358,035 | A | 10/1994 | Grudzinski | 166/53 |
| 5,367,694 | A | 11/1994 | Ueno | 395/800 |
| 5,394,141 | A | 2/1995 | Soulier | 340/854.4 |
| 5,396,232 | A | 3/1995 | Mathieu et al. | 340/854.5 |
| 5,425,425 | A | 6/1995 | Bankston et al. | 166/377 |
| 5,447,201 | A | 9/1995 | Mohn | 166/375 |
| 5,458,200 | A | 10/1995 | Lagerlef et al. | 166/372 |
| 5,467,083 | A | 11/1995 | McDonald et al. | 340/854.6 |
| 5,473,321 | A | 12/1995 | Goodman et al. | 340/854.9 |
| 5,493,288 | A | 2/1996 | Henneuse | 340/854.4 |
| 5,531,270 | A | 7/1996 | Fletcher et al. | 166/53 |
| 5,561,245 | A | 10/1996 | Georgi et al. | 73/152.02 |
| 5,574,374 | A | 11/1996 | Thompson et al. | 324/338 |
| 5,576,703 | A | 11/1996 | MacLeod, deceased et al. | 340/854.4 |
| 5,587,707 | A | 12/1996 | Dickie et al. | 340/870.09 |
| 5,592,438 | A | 1/1997 | Rorden et al. | 367/83 |
| 5,662,165 | A | 9/1997 | Tubel et al. | 166/250.01 |
| 5,723,781 | A | 3/1998 | Pruett et al. | 73/152.18 |
| 5,730,219 | A | 3/1998 | Tubel et al. | 66/250.01 |
| 5,745,047 | A | 4/1998 | Van Gisbergen et al. | 340/853.1 |
| 5,782,261 | A | 7/1998 | Becker et al. | 137/155 |
| 5,797,453 | A | 8/1998 | Hisaw | 166/117.5 |
| 5,881,807 | A | 3/1999 | B.o slashed.e et al. | 166/100 |
| 5,883,516 | A | 3/1999 | Van Steenwyk et al. | 324/366 |
| 5,887,657 | A | 3/1999 | Bussear et al. | 166/336 |
| 5,896,924 | A | 4/1999 | Carmody et al. | 166/53 |
| 5,934,371 | A | 8/1999 | Bussear et al. | 166/53 |
| 5,937,945 | A | 8/1999 | Bussear et al. | 166/250.15 |
| 5,941,307 | A | 8/1999 | Tubel | 166/313 |
| 5,955,666 | A | 9/1999 | Mullins | 73/52.18 |
| 5,959,499 | A | 9/1999 | Khan et al. | 330/149 |
| 5,960,883 | A | 10/1999 | Tubel et al. | 166/313 |
| 5,963,090 | A | 10/1999 | Fukuchi | 330/149 |
| 5,971,072 | A | 10/1999 | Huber et al. | 166/297 |
| 5,975,204 | A | 11/1999 | Tubel et al. | 166/250.15 |
| 5,995,020 | A | 11/1999 | Owens et al. | 340/854.9 |
| 6,012,015 | A | 1/2000 | Tubel | 702/6 |
| 6,012,016 | A | 1/2000 | Bilden et al. | 702/12 |
| 6,070,608 | A | 6/2000 | Pringle | 137/155 |
| 6,123,148 | A | 9/2000 | Oneal | 166/118 |
| 6,148,915 | A | 11/2000 | Mullen et al. | 166/278 |
| 6,192,983 | B1 | 2/2001 | Neuroth et al. | 166/278 |
| 6,208,586 | B1 | 3/2001 | Rorden et al. | 367/35 |
| 6,334,486 | B1 | 1/2002 | Carmody et al. | 166/53 |
| 6,484,800 | B2 | 11/2002 | Carmody et al. | 166/53 |

FOREIGN PATENT DOCUMENTS

| | | | | |
|---|---|---|---|---|
| EP | 295178 | | 6/1988 | E21B/47/12 |
| EP | 339825 | | 11/1989 | E21B/47/12 |
| EP | 492856 | A2 | 7/1992 | H04B/1/62 |
| EP | 641916 | A2 | 3/1995 | E21B/33/124 |
| EP | 681090 | A2 | 11/1995 | E21B/47/18 |
| EP | 697500 | A2 | 2/1996 | E21B/49/00 |
| EP | 732053 | A1 | 9/1996 | A21C/9/04 |
| EP | 721.053 | A1 | 10/1996 | E21B/47/12 |
| EP | 919696 | A2 | 6/1999 | E21B/47/12 |
| EP | 922835 | A3 | 6/1999 | E21B/43/14 |
| EP | 930518 | A2 | 7/1999 | G01V/3/12 |
| EP | 964134 | A2 | 12/1999 | E21B/47/12 |
| EP | 972909 | A2 | 1/2000 | E21B/44/00 |
| EP | 999341 | A2 | 5/2000 | E21B/33/124 |
| FR | 2677134 | | 12/1992 | E21B/47/12 |
| GB | 2083321 | A | 3/1982 | H04B/5/00 |
| GB | 2325949 | A | 12/1998 | E21B/43/12 |
| GB | 2327695 | | 2/1999 | E21B/43/12 |
| GB | 2338253 | | 12/1999 | E21B/47/12 |
| WO | 80/00727 | | 4/1990 | E21B/47/12 |
| WO | 93/26115 | | 12/1993 | H04N/1/40 |
| WO | 96/00836 | | 1/1996 | E21B/47/12 |
| WO | 96/24747 | | 8/1996 | E21B/43/12 |
| WO | 97/16751 | | 5/1997 | G01V/3/00 |
| WO | 97/37103 | | 10/1997 | E21B/47/01 |
| WO | 98/20233 | | 5/1998 | E21B/43/40 |
| WO | 99/37044 | | 7/1999 | H04B/13/02 |
| WO | 99/57417 | | 11/1999 | E21B/41/00 |
| WO | 99/60247 | | 11/1999 | E21B/43/12 |
| WO | 00/04275 | | 1/2000 | E21B/47/01 |
| WO | 00/37770 | | 6/2000 | E21B/37/06 |
| WO | 01/20126 | A2 | 3/2001 | E21B/43/12 |
| WO | 01/55555 | A1 | 8/2001 | E21B/47/12 |

OTHER PUBLICATIONS

Der Spek, Alex, and Alix Thomas, "Neural–Net Identification of Flow Regime with Band Spectra of Flow–Generated Sound ", SPE Reservoir Eva. & Eng.2 (6) Dec. 1999, pp. 489–498.

Otis Engineering pub dated Aug. 1980 "Heavy Crude Lift System" Field Dulput Report OEC 6228, Otis Corp. Dallas TX 1980.

Sakata et al., "Performance Analysis of Long Distance Transmitting of Magnetic Signal on Cylindrical Steel Rod", IEEE Translation Journal on magnetics in Japan, vol. 8, No. 2. Feb. 1993,, pp. 102–106.

Brown. Connolizo and Robertson, West Texas Oil Lifting Short Course and H.W. Winkler, "Misunderstood or overlooked Gas–Lift Design and Equipment Considerations," SPE, p. 351 (1994).

Der Spek, Alex, and Aliz Thomas, "Neural–Net Identification of Flow Regime with Band Spectra of Flow–Generated Sound", SPE Reservoir Eva. & Eng.2 (6) Dec. 1999, pp. 489–498.

32
30
20
46
47
46
44
22
312
26
40
31
24
24
64
41
41
52
26
132
66
58
64
24
41
41
52
24
31
132
66
64
41
41
52
132
66
64
41
41
52
132
66
64
42
42
52
26
132
66
182
182
314
48
48

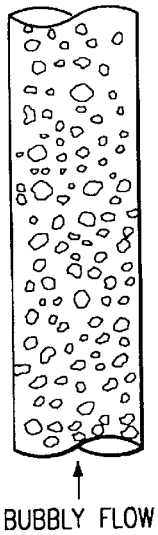
FIG. 9A
(PRIOR ART)
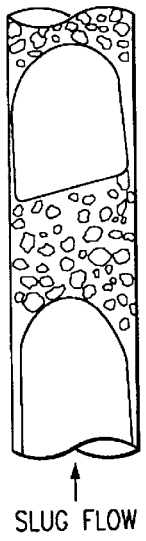
FIG. 9B
(PRIOR ART)
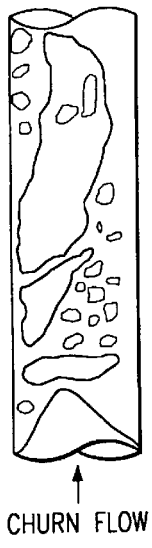
FIG. 9C
(PRIOR ART)
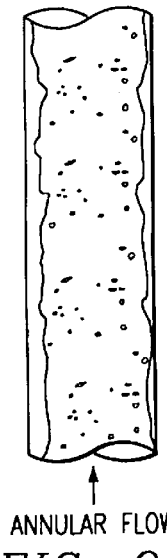
FIG. 9D
(PRIOR ART)
FIG. 10A
(PRIOR ART)
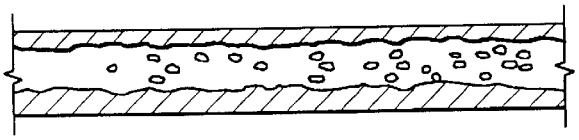
FIG. 10B
(PRIOR ART)
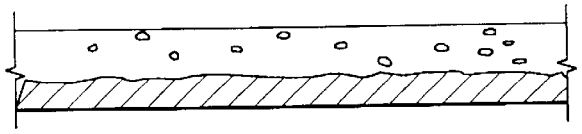
FIG. 10C
(PRIOR ART)
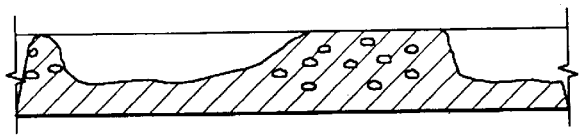
FIG. 10D
(PRIOR ART)
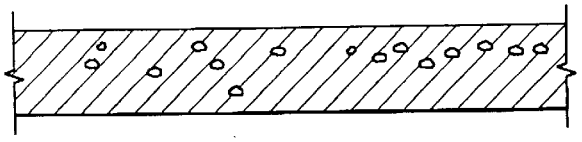

SYSTEM AND METHOD FOR FLUID FLOW OPTIMIZATION

CROSS-REFERENCES TO RELATED APPLICATIONS

This application claims the benefit of the U.S. Provisional Applications in the following table, all of which are hereby incorporated by reference:

U.S. PROVISIONAL APPLICATIONS

| T&K # | Serial Number | Title | Filing Date |
|---|---|---|---|
| TH 1599 | 60/177,999 | Toroidal Choke Inductor for Wireless Communication and Control | Jan. 24, 2000 |
| TH 1599x | 60/186,376 | Toroidal Choke Inductor for Wireless Communication and Control | Mar. 2, 2000 |
| TH 1600 | 60/178,000 | Ferromagnetic Choke in Wellhead | Jan. 24, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |
| TH 1602 | 60/178,001 | Controllable Gas-Lift Well and Valve | Jan. 24, 2000 |
| TH 1603 | 60/177,883 | Permanent, Downhole, Wireless, Two-Way Telemetry Backbone Using Redundant Repeater, Spread Spectrum Arrays | Jan. 24, 2000 |
| TH 1668 | 60/177,998 | Petroleum Well Having Downhole Sensors, Communication, and Power | Jan. 24, 2000 |
| TH 1669 | 60/177,997 | System and Method for Fluid Flow Optimization | Jan. 24, 2000 |
| TS6185 | 60/181,322 | Optimal Predistortion in Downhole Communications System | Feb. 9, 2000 |
| TH 1671 | 60/186,504 | Tracer Injection in a Production Well | Mar. 2, 2000 |
| TH 1672 | 60/186,379 | Oilwell Casing Electrical Pick-Off Points | Mar. 2, 2000 |
| TH 1673 | 60/186,375 | Controllable Production Well Packer | Mar. 2, 2000 |
| TH 1674 | 60/186,382 | Use of Downhole High Pressure Gas in a Gas Lift | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications in the following table, all of which are hereby incorporated by reference:

COMMONLY OWNED AND CONCURRENTLY FILED U.S. PATENT APPLICATIONS

| T&K # | Serial Number | Title | Filing Date |
|---|---|---|---|
| TH 1599US | 09/769,047 | Toroidal Choke Inductor for Wireless Communication and Control | Jan. 24, 2001 |
| TH 1600US | 09/769,048 | Induction Choke for Power Distrition in Pipng Structure | Jan. 24, 2001 |
| TH 1602US | 09/768,705 | Controllable GAs-Lift Well and Valve | Jan. 24, 2001 |
| TH 1603US | 09/768,655 | Permanent, Downhole, Wireless, Two-Way Telemetry Backbone Using Redundant Repeaters | Jan. 24, 2001 |
| TH 1668US | 09/769,046 | Petoleum Well Having Downhole Sensors, Communications, and Power | Jan. 24, 2001 |

BACKGROUND OF THE INVENTION

1. Field of the Invention

The present invention relates to a system and method for optimizing fluid flow in a pipe and in particular, fluid flow in a gas-lift well.

2. Description of Related Art

Gas-lift wells have been in use since the 1800's and have proven particularly useful in increasing efficient rates of oil production where the reservoir natural lift is insufficient (see Brown, Connolizo and Robertson, *West Texas Oil Lifting Short Course* and H. W. Winkler, *Misunderstood or Overlooked Gas-lift Design and Equipment Considerations*, SPE, p. 351 (1994)). Typically, in a gas-lift oil well, natural gas produced in the oil field is compressed and injected in an annular space between the casing and tubing and is directed from the casing into the tubing to provide a "lift" to the tubing fluid column for production of oil out of the tubing. Although the tubing can be used for the injection of the lift-gas and the annular space used to produce the oil, this is rare in practice. Initially, the gas-lift wells simply I*njected the gas at the bottom of the tubing, but with deep wells this requires excessively high kick-off pressures. Later, methods were devised to inject the gas into the tubing at various depths in the wells to avoid some of the problems associated with high kick-off pressures (see U.S. Pat. No. 5,267,469).

The most common type of gas-lift well uses mechanical, bellows-type gas-lift valves attached to the tubing to regulate the flow of gas from the annular space into the tubing string (see U.S. Pat. Nos. 5,782,261 and 5,425,425). In a typical bellows-type gas-lift valve, the bellows is preset or pre-charged to a certain pressure such that the valve permits communication of gas out of the annular space and into the tubing at the pre-charged pressure. The pressure charge of each valve is selected by a well engineer depending upon the position of the valve in the well, the pressure head, the physical conditions of the well downhole, and a variety of other factors, some some of which are assumed or unknown, or will change over the production life of the well.

The typical bellows-type gas-lift valve has a pre-charge cylinder for regulating the gas flow between the annular space and the interior of the tubing string. The pre-charge forces a ball against a valve seat to keep the valve closed at operating pressures below the pre-charge pressure. Several problems are common with bellows-type gas-lift valves. First, the bellows often loses its pre-charge, causing the valve to fail in the closed position or operate at other than the design goal, and exposure to overpressure causes similar problems. Another common failure is erosion around the valve seat and deterioration of the ball stem in the valve. This leads to partial failure of the valve or at least inefficient production. Because the gas flow through a gas-lift valve is often not continuous at a steady state, but rather exhibits a certain amount of hammer and chatter as the ball rapidly opens and closes, ball and valve seat degradation are common, and lead to gas leakage. Failure or inefficient operation of bellows-type valves leads to corresponding inefficiencies in operation of a typical gas-lift well. In fact, it is estimated that well production is at least 5–15% less than optimum because of valve failure or operational inefficiencies. Fundamentally these difficulties are caused by the present inability to monitor, control, or prevent instabilities, since the valve characteristics are set at design time, and even without failure they cannot be easily changed after the valve is installed in the well.

It would, therefore, be a significant advantage if a system and method were devised which overcame the inefficiency of conventional bellows-type gas-lift valves. Several methods have been devised to place controllable valves downhole on the tubing string but all such known devices typically use an electrical cable or hydraulic pipe disposed along the tubing string to power and communicate with the gas-lift valves. It is, of course, highly undesirable and in practice difficult to use a cable along the tubing string either integral with the tubing string or spaced in the annulus between the tubing string and the casing because of the number of failure mechanisms present in such a system. The use of a cable presents difficulties for well operators while assembling and inserting the tubing string into a borehole. Additionally, the cable is subjected to corrosion and heavy wear due to movement of the tubing string within the borehole. An example of a downhole communication system using a cable is shown in PCT/EP97/01621.

U.S. Pat. No. 4,839,644 describes a method and system for wireless two-way communications in a cased borehole having a tubing string. However, this system describes a communication scheme for coupling electromagnetic energy in a TEM mode using the annulus between the casing and the tubing. This inductive coupling requires a substantially nonconductive fluid such as crude oil or diesel oil in the annulus between the casing and the tubing. The invention described in U.S. Pat. No. 4,839,644 has not been widely adopted as a practical scheme for downhole two-way communication because it is expensive, has problems with brine leakage into the casing, and is difficult to use. Another system for downhole communication using mud pulse telemetry is described in U.S. Pat. Nos. 4,648,471 and 5,887,657. Although mud pulse telemetry can be successful at low data rates, it is of limited usefulness where high data rates are required or where it is undesirable to have complex, mud pulse telemetry equipment downhole. Other methods of communicating within a borehole are described in U.S. Pat. Nos. 4,468,665; 4,578,675; 4,739,325; 5,130,706; 5,467,083; 5,493,288; 5,574,374; 5,576,703; and 5,883,516. Methods and uses of downhole permanent sensors and control systems are described in U.S. Pat. Nos. 4,972,704; 5,001,675; 5,134,285; 5,278,758; 5,662,165; 5,730,219; 5,934,371; 5,941,307.

It is generally known that in a gas-lift well, an increase of compressed gas injected downhole (i.e. lift-gas) does not linearly correspond to the amount of oil produced. More specifically, for any particular well under a particular set of operating conditions, the amount of gas injected can be optimized to produce the maximum oil. Unfortunately, using conventional bellows type valves, the opening pressure of the gas-lift bellows type valves is preset and the primary control of the well is through the amount of gas injected at the surface. Feedback to determine optimum production of the well can take many hours and even days.

It is also generally known that in two-phase flow regimes, such as in a gas-lift well, several flow regimes exist with varying efficiencies (see A. van der Spek and A. Thomas, *Neural Net Identification of Flow Regime Using Band Spectra of Flow Generated Sound*, SPE 50640, October 1998). However, while operating in a particular flow regime is known to be desirable, it has largely been considered impossible to practically implement.

It would, therefore, be a significant advance in the operation of gas-lift wells if an alternative to the conventional bellows-type valve were provided, in particular, if sensors for determining flow characteristics in the well could work with controllable gas-lift valves and surface controls to optimize fluid flow in a gas-lift well. Generally, it would be a significant advance to be able to detect the flow regime in a two-phase flow conduit and to control the operation to remain in a desirable phase.

All references cited herein are incorporated by reference to the maximum extent allowable by law. To the extent a reference may not be fully incorporated herein, it is incorporated by reference for background purposes and indicative of the knowledge of one of ordinary skill in the art.

SUMMARY OF THE INVENTION

The problems outlined above are largely solved by the system and method in accordance with the present invention for determining a flow regime and controlling the flow characteristics to attain a desirable regime. In a preferred embodiment, a controllable gas-lift well includes a cased wellbore having a tubing string positioned within and longitudinally extending within the casing. An annular space is defined between the casing and the tubing string. In the simplest case a controllable gas-lift valve is coupled to the tubing string to control the gas injection between the annular space and an interior of the tubing string, normally the lowest valve in the lift production tubing. In a more complete and desirable case any or all of the intermediate valves used for unloading and kick-off may be controllable. The controllable gas-lift valve and sensors are powered and controlled from the surface to regulate such tasks as the fluid communication between the annular space and the interior of the tubing and the amount of gas injected at the surface. Communication signals and power are sent from the surface using the tubing and casing as conductors. The power is preferably a low voltage AC current around 60 Hz.

In more detail, a surface computer having a modem imparts a communication signal to the tubing, and the signal is received by a modem downhole connected to the controllable gas-lift valve. Similarly, the modem downhole can communicate sensor information to the surface computer. Further, power is input into the tubing string and received downhole to control the operation of the controllable gas-lift valve. Preferably, the casing is used as the ground return conductor. Alternatively, a distant ground may be used as the electrical return. In a preferred embodiment, the controllable gas-lift valve includes a stepper motor which operates to insert and withdraw a cage trim valve from a seat, regulating the gas injection between the annulus and the interior of the tubing. The ground return path is provided from the controllable gas-lift valve via a packer or a conductive centralizer around the tubing which is in electrical contact with the tubing, and is also in electrical contact with the casing.

In enhanced form, the controllable gas-lift well includes one or more sensors downhole which are preferably in contact with the downhole modem and communicate with the surface computer. In addition to acoustic sensors, sensors such as temperature, pressure, hydrophone, geophone, valve position, flow rate, and differential pressure sensors provide important information about conditions downhole. The sensors supply measurements to the modem for transmission to the surface or directly to a programmable interface controller for determining the flow regime at a given location and operating the controllable gas-lift valve and surface gas injection for controlling the fluid flow through the gas-lift valve.

Preferably, ferromagnetic chokes are coupled to the tubing to act as a series impedance to current flow on the tubing. In a preferred form, an upper ferromagnetic choke is placed around the tubing below the tubing hanger, and the current and communication signals are imparted to the tubing below and the upper ferromagnetic choke. A lower ferromagnetic choke is placed downhole around the tubing with the controllable gas-lift valve electrically coupled to the tubing above the lower ferromagnetic choke, although the controllable gas-lift valve may be mechanically coulped to the tubing below the lower ferromagnetic choke. It is desirable to mechanically place the operating controllable gas-lift valve below the lower ferromagnetic choke so that the borehole fluid level is below the choke.

Preferably, a surface controller (computer) is coupled via a surface master modem and the tubing to the downhole slave modem of the controllable gas-lift valve. The surface computer can receive measurements from a variety of sources, such as the downhole sensors, measurements of the oil output, and measurements of the compressed gas input to the well (flow and pressure). Using such measurements, the computer can compute an optimum position of the controllable gas valve, and more particularly, the optimum amount of the gas injected from the annular space through each controllable valve into the tubing. Additional parameters may be controlled by the computer, such as controlling the amount of compressed gas input into the well at the surface, controlling back pressure on the wells, controlling a porous frit or surfactant injection system to foam the oil, and receiving production and operation measurements from a variety of the wells in the same field to optimize the production of the field.

The ability to actively monitor current conditions downhole, coupled with the ability to control surface and downhole conditions, has many advantages in a gas-lift well. Conduits such as gas-lift wells have four broad regimes of fluid flow, namely bubbly, Taylor, slug and annular flow. The most efficient production (oil produced versus gas injected) flow regime is the Taylor flow regime.

The downhole sensors of the present invention enable the detection of Taylor flow. The above referenced control mechanisms—surface computer, controllable valves, gas input, surfactant injection, etc.—provide the ability to attain and maintain Taylor flow. In enhanced forms, the downhole controllable valves may be operated independently to attain localized Taylor flow.

In the preferred embodiments, all of the gas lift valves in the well are of the controllable type and may be independently controlled. It is desirable to lift the oil column from a point on the borehole as close as possible to the production packer. More specifically, the lowest gas-lift valve is the primary valve in production. The upper gas-lift valves are used for unloading and kick-off of the well during production initiation. In conventional gas-lift wells, these upper valves have bellows pre-set with a 200 psi margin of error to ensure the valves close after set off. This means lift pressure is lost downhole to accommodate this 200 psi loss per valve. Further, such conventional valves often leak and fail to fully close. Use of the controllable valves of the present invention overcomes such shortcomings.

Construction of such a controllable gas-lift well is designed to be as similar to conventional construction methodology as possible. That is, after casing the well, a packer is typically set above the production zone. The tubing string is the fed through the casing into communication with the production zone. As the tubing string is made up at the surface, a lower ferromagnetic choke is placed around one of the conventional tubing string sections for positioning above the downhole packer. In the sections of the tubing string where it is desired, a gas-lift valve is coupled to the string. A pre-assembled pipe joint prepared with the choke and its associated electronics module, and a controllable gas lift valve, may be used to improve efficiency of field operations. In a preferred form, a side pocket mandrel for receiving a slickline insertable and retractable gas-lift valve is used. With such configuration, either a controllable gas-lift valve in accordance with the present invention can be inserted in the side pocket mandrel or a conventional bellows-type valve can be used. Alternatively, the controllable gas-lift valve may be tubing conveyed. When make-up of the tubing string nears completion, a ferromagnetic choke is again placed around an upper joint of the tubing string, this time just below the tubing hanger, or a prefabricated joint with choke already installed may be used. Communication and power leads are then connected through the wellhead feed through to the tubing string below the upper ferromagnetic choke.

In an alternative form, a sensor and communication pod is inserted without the necessity of including a controllable gas-lift valve. That is, an electronics module having pressure, temperature or acoustic, or other sensors, a power supply, and a modem is inserted into a side pocket mandrel for communication to the surface computer using the tubing string and casing as conductors. Alternatively, electronics modules may be mounted directly on the tubing (tubing conveyed) and not be configured to be wireline replaceable. If directly mounted to the tubing an electronic module or a controllable gas-lift valve may only be replaced by pulling the entire tubing string. In an alternative form, the controllable valve can have its separate control, power and wireless communication electronics mounted in the side pocket mandrel of the tubing and not in the wireline replaceable valve. In the preferred form, the electronics are integral and replaceable along with the gas-lift valve. In another form, the high permeability magnetic chokes may be replaced by electrically insulated tubing sections. Further, an insulated tubing hanger in the wellhead may replace the upper choke or such upper insulating tubing sections.

Although the downhole sensors, electronics modules, and valves can be configured in many different ways, the primary function of the components is to determine and regulate the existing flow regime of oil and gas in the tubing string. Sensor measurements are communicated to the surface using the tubing string and the casing as conductors. These measurements are then used to calculate and regulate gas injection, both at the surface and downhole, in order to obtain the desired downhole flow regime.

BRIEF DESCRIPTION OF THE DRAWINGS

FIGS. 9A–9D are a series of fragmentary, vertical sectional views of flow patterns in two-phase vertical (upward) flow, wherein FIG. 9A illustrates bubbly flow, FIG. 9B illustrates slug flow, FIG. 9C illustrates churn flow, and FIG. 9D illustrates annular flow.

FIGS. 10A–10D illustrate flow patterns in horizontal two-phase flow, wherein FIG. 10A illustrates annular dispersed flow, FIG. 10B illustrates stratified wavy flow, FIG. 10C illustrates slug or intermittent flow, and FIG. 10D illustrates dispersed bubble flow.

DETAILED DESCRIPTION OF THE INVENTION

Description of Flow Regimes

Figure 1:
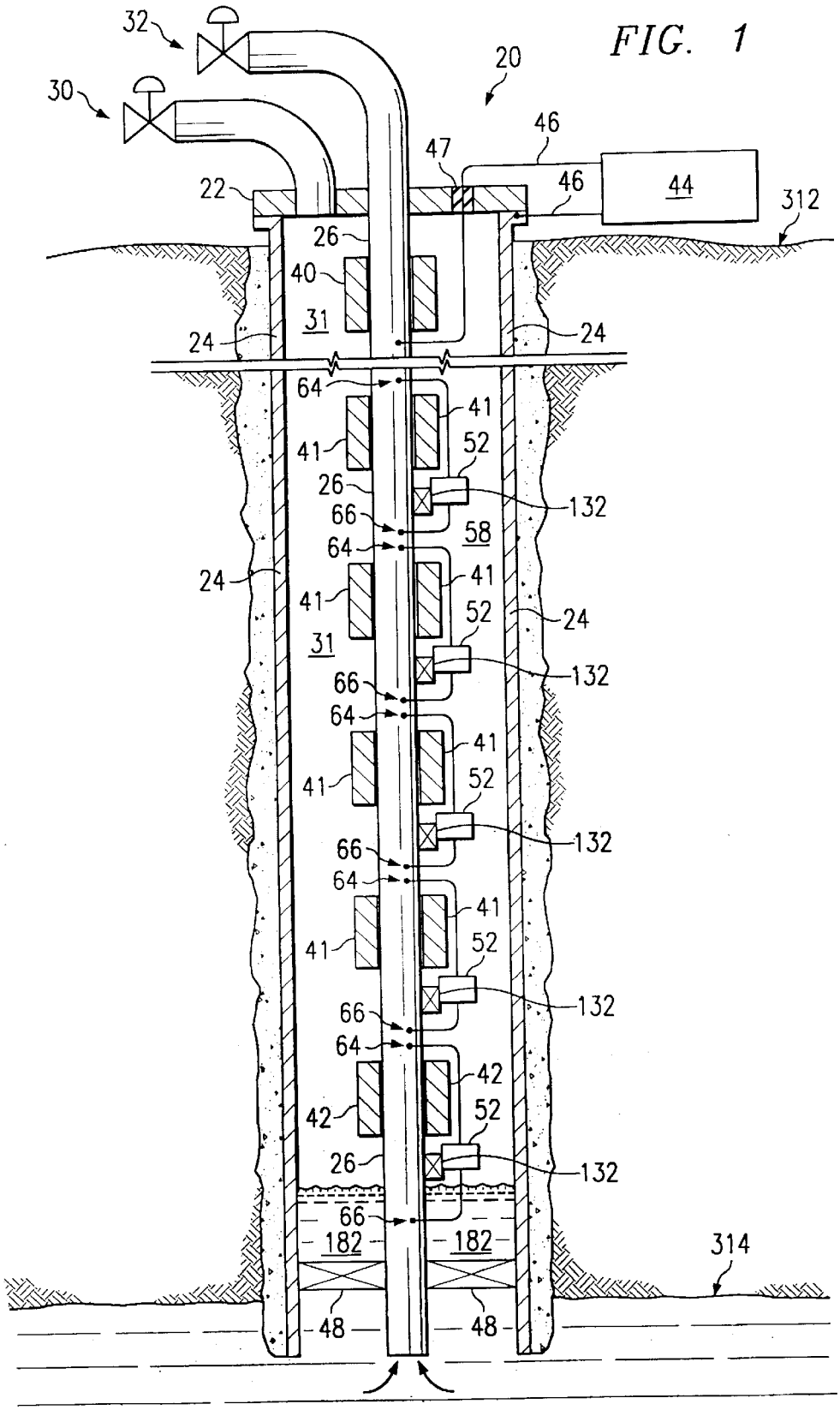
FIG. 1 is a schematic of the controllable gas-lift well in accordance with a preferred embodiment of the present invention.

Without a flow regime classification, it is difficult to quantify fluid flow rates of two-phase flow in a conduit. The conventional method of flow regime classification is by visual observation of flow in a conduit by a human observer. Although downhole video surveys are commercially available, visual observation of downhole flow is not standard practice as it requires a special wireline (optical fiber cable). Moreover, downhole video surveys can only be successful in transparent fluids; either gas wells or wells killed with clear kill fluid. In oil wells, an alternative to visual observation for classifying the flow regime is needed.

All flow regimes produce their own characteristic sounds. A trained human observer can classify a flow regime in a pipe by aural rather than visual observations. Contrary to video surveys, sound logging services are available from various cased hole wireline service providers. The traditional use of such sound logs is to pinpoint leaks in either casing or tubing strings. In addition to the sound logs recorded, a surface control panel is equipped with amplifiers and speakers that allow audible observation of downhole produced sounds. The sound log typically is a plot of uncalibrated, sound pressure level after passing the sound signal through 5 different high pass filters (noise cuts: 200 Hz, 600 Hz, 1000 Hz, 2000 Hz and 4000 Hz) vs. along hole depth. In principle, the logging engineer, based on aural observation of the downhole sounds, could carry out flow regime classification. This procedure, however, is impractical because it is prone to errors, it cannot be reproduced from recorded logs (the sound is not normally recorded on audio tape), and it relies on the experience of the specific engineer.

Successful application of neural net classification of flow regime from sound logs in the field brings several benefits to the business. First it allows the application of the correct, flow regime specific, hydraulic model to the task of evaluating horizontal well, two-phase flow production logs. Second, it allows a more constrained consistency check on recorded production logging data. Finally, it alleviates the need to predict flow regime using hydraulic stability criteria from first principles thereby reducing computational loads by at least a factor of 10 resulting in faster turn around times.

Neural net classification is performed by analyzing the acoustic signature of flow within a conduit. Acoustic signature is a way of characterizing the acoustic waveform. One example of acoustic signature is a plot of power received by an acoustic sensor vs. frequency. A different acoustic signature will be present for each different flow regime.

Flow Regimes

"Two-phase flow is the interacting flow of two phases, liquid, solid or gas, where the interface between the phases is influenced by their motion" (Butterworth and Hewitt, *Two Phase Flow and Heat Transfer*, Atomic Energy Research Establishment, Oxford Univ. Press, Great Britain, 1979). In the present application "multi-phase flow" is intended to include two-phase flow. Many different flow patterns can result from the changing form of the interface between the two phases. These patterns depend on a variety of factors. For instance, the phase flow rates, the pressure, and the diameter and inclination of the pipe containing the flow in question all affect the flow pattern. Flow regimes in vertical upward flow are illustrated in FIGS. 9A–9D and include:

- Bubbly flow: A dispersion of bubbles in a continuum of liquid.
- Intermittent or Slug flow: The bubble diameter approaches that of the tube. The bubbles are bullet shaped. Small bubbles are suspended in the intermediate liquid cylinders.
- Churn or froth flow: A highly unstable flow of an oscillatory nature, whereby the liquid near the pipe wall continuously pulses up and down.
- Annular flow: A film of liquid flows on the wall of the pipe and the gas phase flows in the center.

The above-mentioned flow patterns are obtained with progressively increasing gas rate, bubbly flow being present at a lower gas rate, and annular flow being present at a higher gas rate. For gas wells, annular flow is expected over a major part of the tubing, whereas for oil wells intermittent flow prevails in the upper part of the tubing. At tubing intake conditions, bubbly flow is predominantly present; hence, in the tubing, because of the release of associated gas from oil when the pressure falls, a transition from bubbly flow to intermittent flow occurs.

Flow regimes in horizontal flow are illustrated in FIGS. 10A–10D and are described below:

Bubbly flow: The bubbles tend to float at the top of the liquid.

Intermittent or Slug flow: Large frothy slugs of liquid alternate with large gas pockets.

Stratified flow: The liquid flows along the bottom of the pipe and the gas flows on top.

Annular flow: A liquid ring is attached to the pipe wall with gas blowing through. Usually, the layer at the bottom is very much thicker than the one at the top.

Figure 11:
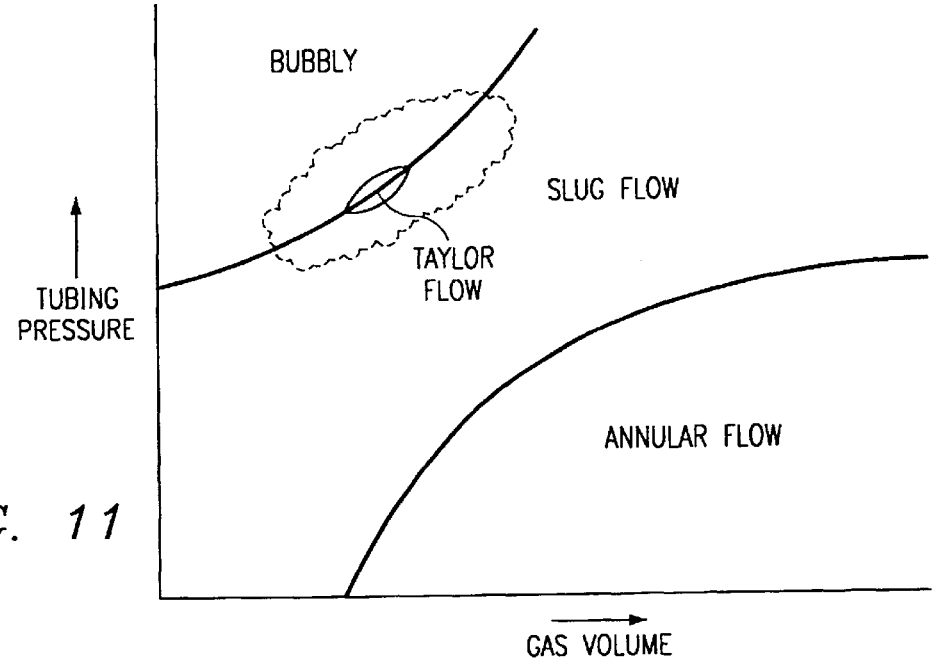
FIG. 11 is a graph plotting tubing pressure vs. quantity of compressed gas and depicts the four flow regimes typically encountered in a gas-lift well, namely bubbly, Taylor, slug flow, and annular flow.

Another flow regime has been identified—Taylor flow—which occurs between Bubbly flow (see FIG. 9A) and Slug flow (see FIG. 9B) and has characteristics of each. More specifically, as illustrated in FIG. 11, Taylor flow is a most desirable flow regime for maximizing oil output for a quantity of gas injected. Although the preferred embodiment is primarily concerned with achieving Taylor flow in a vertical oil well, the principles are applicable to horizontal wells (see FIGS. 10A–10B) and most two-phase flows in a conduit. Superficial velocity, vs, is the ratio of volumetric flow rate at line conditions, Q, to the cross-section of the pipe, A, such that:

$$vs = \frac{Q}{A} \tag{1}$$

Superficial velocity is the velocity that a phase would have had if it were the only phase in the pipe. Gas volume fraction (GVF) is the superficial gas velocity, $V_{se}$, divided by the sum of the superficial gas velocity and the superficial liquid velocity, $V_{st}$.

$$GVF = \frac{V_{se}}{V_{se} + V_{st}} \tag{2}$$

The gas volume fraction is pressure dependent.

A convenient and illustrative way to depict flow regimes vs. flow rates is to map flow regime on a two dimensional plane with superficial gas velocity on the horizontal axis and superficial liquid velocity on the vertical axis for a given pipe inclination. In theory, eight variables are needed to define a flow regime in a pipe. In an angle dependent flow map representation, a simplified parameter space may be employed in which only three variables are used. In this case, the approach is justified because the three flow map variables, i.e. pipe inclination angle, superficial gas velocity and superficial liquid velocity are the only variables that were changed in the course of the studies. All other variables, i.e. gas and liquid density and viscosity, surface tension, pipe diameter and pipe roughness are fixed (Wu, Pots, Hollenberg, Meerhoff, "Flow Pattern Transitions in Two-Phase Gas/Condensate Flow at High Pressures in an 8 Inch Horizontal Pipe," *Proc. of the Third International Conf. on Multiphase-Phase Flow,* The Hague, The Netherlands, 18–20 May, pp. 13–21, 1987; Oliemans, Pots, Trompe, "Modeling of Annular Dispersed Two-Phase Flow in Vertical Pipes," *J. Multiphase Flow,* 12:711–732, 1986).

An exemplary flow map covers three orders of magnitude for both the gas and the liquid flow rate. At 10 m/s liquid superficial velocity, a 4-inch pipe will sustain a flow rate of approximately 10,000 barrels of liquid per day if the liquid were the only fluid flowing in the pipe. Thus such a flow map covers all situations that are of practical use in oilfield application. Since gas volume fraction is the ratio of superficial gas velocity to the sum of superficial gas velocity and superficial liquid velocity, lines of constant gas volume fraction appear on the flow map as straight parallel lines of 45-degree slope. The 50% GVF line is the line passing through the points (10, 10) and (0.01, 0.01). To the right of this line, higher gas volume fractions occur, whereas to the left the gas volume fraction decreases.

Sound Measurements

Sound is rarely made up of only one frequency. Hence, in order to analyze it, a whole range of frequencies should be investigated. The chosen frequency spectrum can be divided into contiguous bands (Pierce, "Acoustics—An Introduction to Its Physical Principles and Applications," *Mech. Eng.,* McGraw Hill, 1981) such that:

$$f_u(n)=f_L(n+1) \tag{3}$$

and subsequently, $$f_u(n+1)=f_L(n+2) \tag{4}$$

where the $n^{th}$ band is limited by a lower frequency $f_L(n)$ and an upper frequency $f_u(n)$. The bands are said to be proportional if the ratio $f_u(n)/f_L(n)$ is the same for each band. An octave is a band for which:

$$f_u=2f_L \tag{5}$$

i.e. the top frequency is twice the lower limit frequency of the band. In the same way, a one third octave band is one where:

$$f_u=\sqrt[3]{2f_l} \tag{6}$$

Any proportional band is defined by its center frequency. This is given by:

$$f_o=\sqrt{f_u f_l} \tag{7}$$

The standard ⅓ octave-partitioning scheme (ANSI S.1.6-1967 (R 1976)) uses the fact that ten ⅓ octave bands are nearly a decade. Standard ⅓ octave bands are such that:

$$f_o n+10=10f_o(n) \tag{8}$$

i.e. 1, 10, 100, 1000 and so on are some of the standard ⅓ octave center frequencies. A graphical display of ⅓ octave band numbers vs. frequency can be made. On a logarithmic scale ⅓ octave bands are equidistant and are of the same width.

Two analysis ranges used by recording equipment are the 100 kHz and 1 kHz ranges. The 100 kHz range covers the bands 20 through 49. The 1 kHz range covers the bands 1 to 28. Apart from ⅓ octave spectra and full octave spectra, an alternative partitioning scheme using decades is also possible. The center frequencies of two adjacent decade bands have a ratio of 10.

The signal magnitude in any given band is expressed as sound pressure level. The sound pressure level (SPL) has a logarithmic scale and is measured in decibels (dB) (Kinsler, Frey, Coppens, Sanders, *Fundamentals of Acoustics*, $3^{rd}$ ed., Wiley, 1982). If p is the sound pressure then, $$SPL = 10\log\left(\frac{\langle p^2\rangle}{\langle p_{ref}^2\rangle}\right), \tag{9}$$

where $P_{ref}$ is a reference pressure, often taken to be 1 $\mu$Pa in underwater acoustics. Putting the concept of decibels into a more familiar context, in air (reference pressure of 20 $\mu$Pa), 0 dB is the threshold of acute hearing of a human being while 130 dB would be the level of a sound inducing acute pain. Assuming the sources of sound are all incoherent, sound pressure levels can be combined using the following formula:

$$(SPL)_{NEW} = 10\log\left(\sum_n 10^{(SPL)_n/10}\right), \tag{10}$$

where $(SPL)_{NEW}$ is the combined sound pressure level of the n original $(SPL)_n$ levels. For example, given that $(SPL)_1$=100 dB and $(SPL)_2$=120 dB, their sum will be $(SPL)_{SUM}$=120.043 dB≈117 dB.

Neural Networks

An artificial neural network is an information processing system, designed to simulate the activity in the human brain (Caudill and Butler, *Understanding Neural Networks, Computer Explorations Vol* 1 *Basic Networks and Vol* 2 *Advanced Networks*, MIT Press, Cambridge, Mass., 1992). It comprises a number of highly interconnected neural processors and can be trained to recognize patterns within data presented to it such that it can subsequently identify these patterns in previously unseen data. The data presented to a neural network is assigned to one of three sets (Learn set, Training set and Validation set) and labeled accordingly. The training set is used to train the network, where as the validation set is there to monitor the network's performance. The validation set is where the network can put its acquired skills to use on unseen data.

Figure 12:
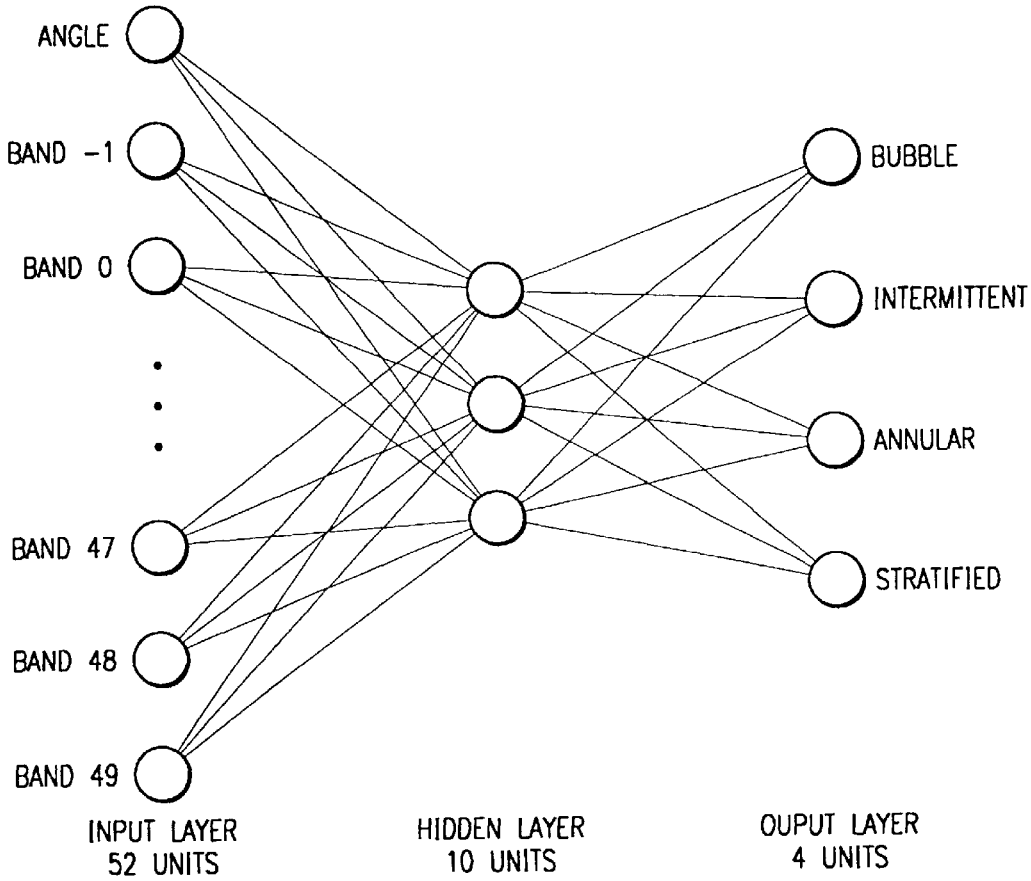
FIG. 12 (PRIOR ART)
FIG. 12 is a block diagram of a feed forward, back propagation neural network for interpretation of acoustic data.

Preferably a feed forward, back propagation neural network such as FIG. 12 is used for interpretation and classification of acoustic sensor data. The neural network architecture for classification problems on ⅓ octave spectra is given in FIG. 12. The neural network consists of three layers, an input layer comprising 52 input units, a hidden layer comprising 16 units, and an output layer having 4 units, each of which corresponds to one of the target flow regime classes. The output units generate a scaled output, a number between 0 and 1 that can be interpreted as the likelihood of occurrence of that particular flow regime given a certain pattern of inputs. The probability estimates of the four output units do not add up to one. Classification is based on the absolute value of each of the calculated likelihood after training the network. Output is considered to be low if its value is 0.5 or below, and high if it is above 0.5. Each sample in a data set can be classified as:

Correct: the output unit corresponding to the target class has a high output, all other output units have a low output.

Wrong: the wrong output unit has high output, all other output units (including the one corresponding to the target class) have a low output.

Unknown: two or more output units have a high output, or all output units have a low output.

Forced correct: the output unit corresponding to the target class has the highest output, irrespective of its absolute value. This number will include all correct samples and some of the unknown samples.

A confusion matrix indicates how the network classified all given regimes. A sensitivity analysis is performed on each input feature. This is expressed as a percentage change in the error, were a particular input to be omitted from the training process. A surface computer processing the sensor data may compare the target regimes to the outputs from the network with the largest and second largest probabilities, denoted best and second best respectively.

DESCRIPTION OF A GAS-LIFT WELL

Referring to FIG. 1 in the drawings, a petroleum well according to the present invention is illustrated. The petroleum well is a gas-lift well 320 having a borehole extending from surface 312 into a production zone 314 that is located downhole. A production platform is located at surface 312 and includes a hanger 22 for supporting a casing 24 and a tubing string 26. Casing 24 is of the type conventionally employed in the oil and gas industry. The casing 24 is typically installed in sections and is cemented in the borehole during well completion. Tubing string 26, also referred to as production tubing, is generally conventional comprising a plurality of elongated tubular pipe sections joined by threaded couplings at each end of the pipe sections. Production platform 20 also includes a gas input throttle 30 to permit the input of compressed gas into an annular space 31 between casing 24 and tubing string 26. Conversely, output valve 32 permits the expulsion of oil and gas bubbles from an interior of tubing string 26 during oil production.

An upper ferromagnetic choke 40 and lower ferromagnetic chokes 41, 42 are installed on tubing string 26 to act as impedances to alternating current flow. The size and material of ferromagnetic chokes 40, 41, 42 can be altered to vary the series impedance value. The section of tubing string 26 between upper choke 40 and lower choke 42 may be viewed as a power and communications path (see also FIG. 6). All chokes 40, 41, 42 are manufactured of high permeability magnetic material and are mounted concentric and external to tubing string 26. Chokes 40, 41, 42 are typically protected with shrink-wrap plastic and fiber-reinforced epoxy to provide electrical insulation and to withstand rough handling.

A computer and power source 44 with power and communication connections 46 is disposed at the surface 312. Where connection 46 passes through the hanger 22 it is electrically isolated from the hanger by a pressure feedthrough 47 located in hanger 22 and is electrically coupled to tubing string 26 below upper choke 40. The neutral connection 46 is connected to well casing 24. Power and communications signals are supplied to tubing string 26 from computer and power source 44, and casing 24 is regarded as neutral return for those signals.

A packer 48 is placed within casing 24 downhole below lower choke 42. Packer 48 is located above production zone 314 and serves to isolate production zone 314 and to electrically connect metal tubing string 26 to metal casing 24. Similarly, above surface 312, the metal hanger 22 (along with the surface valves, platform, and other production equipment) electrically connects metal tubing string 26 to metal casing 24. Typically, the electrical connections between tubing string 26 and casing 24 would not allow electrical signals to be transmitted or received up and down borehole 11 using tubing string 26 as one conductor and casing 24 as another conductor. However, the disposition of ferromagnetic chokes 40, 41, 42 around tubing string 26 alter the electrical characteristics of tubing 26, providing a system and method to convey power and communication signals up and down the tubing and casing of gas-lift well 320.

In one embodiment of the present invention, a plurality of controllable gas-lift valves 52 is operatively connected to tubing string 26. As displayed in FIG. 1, each of the valves along tubing string 26 is a controllable gas-lift valve 52.

In another embodiment not shown in FIG. 1, a plurality of conventional bellows-type gas-lift valves is operatively connected to tubing string 26. The number of conventional valves disposed along tubing string 26 depends upon the depth of the well and the well lift characteristics. Controllable gas-lift valve 52 in accordance with the present invention is attached to tubing string 26 as the penultimate gas-lift valve. In this embodiment, only one controllable gas-lift valve 52 is used; however, more controllable gas-lift valves 52 could be used if desired. The primary drawback to using an increased number of controllable gas-lift valves 52 is increased cost.

Figure 2A:
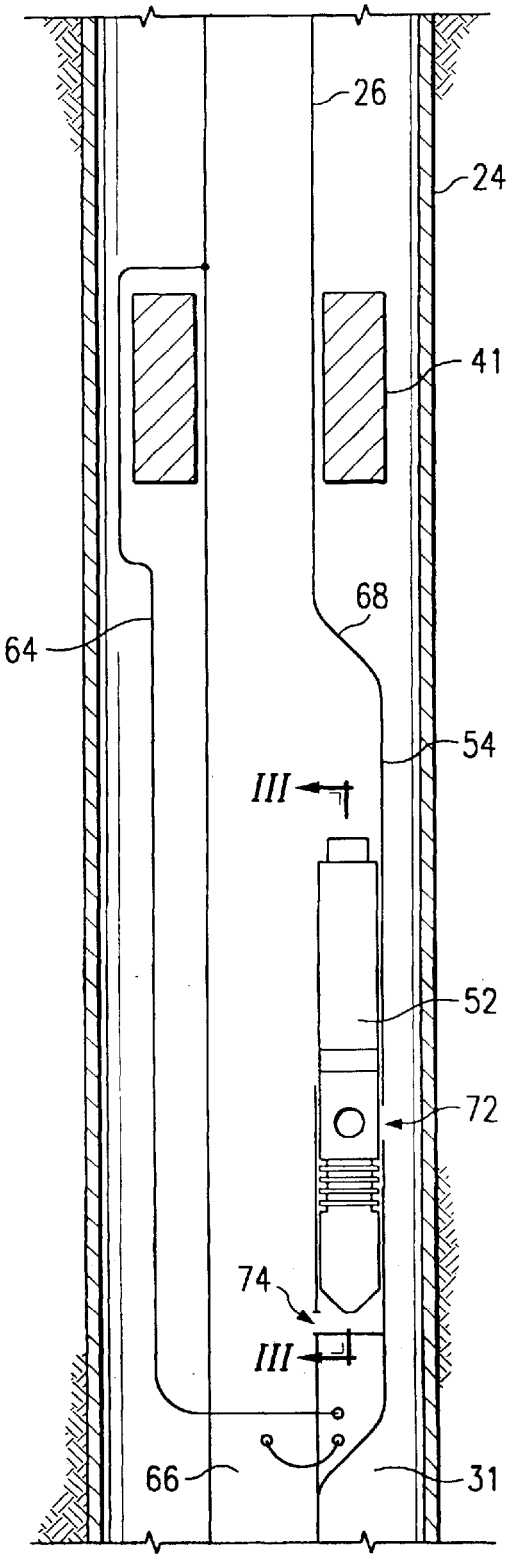
FIG. 2A is an enlarged schematic front view of a side pocket mandrel and a controllable gas-lift valve, the valve having an internal electronics module and being wireline retrievable from the side pocket mandrel.

Referring now to FIG. 2*a* in the drawings, the downhole configuration of controllable valve 52, as well as the electrical connections with casing 24 and tubing string 26, is depicted. The pipe sections of tubing string 26 are conventional and where it is desired to incorporate a gas-lift valve in a particular pipe section, a side pocket mandrel 54, such as those made by Weatherford or Camco, is employed. Each side pocket mandrel 54 is a non-concentric enlargement of tubing string 26 that permits wireline retrieval and insertion of controllable valves 52 downhole.

Any centralizers located between upper and lower chokes 40, 42, must be constructed such as to electrically isolate casing 24 from tubing string 26.

A power and signal connector wire 64 electrically connects controllable valve 52 to tubing string 26 at a point above its associated choke 41. Connector 64 must pass outside the choke 41, as shown in FIG. 2A, for the choke to remain effective. A connector wire 66 provides an electrical return path from controllable valve 52 to tubing 26. Each valve 52 and its associated electronics module is powered and controlled using voltages generated on the tubing 26 by the action of chokes 41, 42.

It should be noted that the power supplied downhole tubing 26 and casing 24 is effective only for choke and control modules that are above the surface of any electrically conductive liquid that may be in annulus 31. Chokes and modules that are immersed in conductive liquid cease to receive signals since such liquid creates an electrical short-circuit between tubing and casing before the signals reach the immersed chokes and modules.

Use of controllable valves 52 is preferable for several reasons. Conventional bellows valves often leak when they should be closed during production, resulting wasteful consumption of lift gas. Additionally, conventional bellows valves 50 are usually designed with an operating margin of about 200 psi per valve, resulting in less than full pressure being available for lift.

Figure 2B:
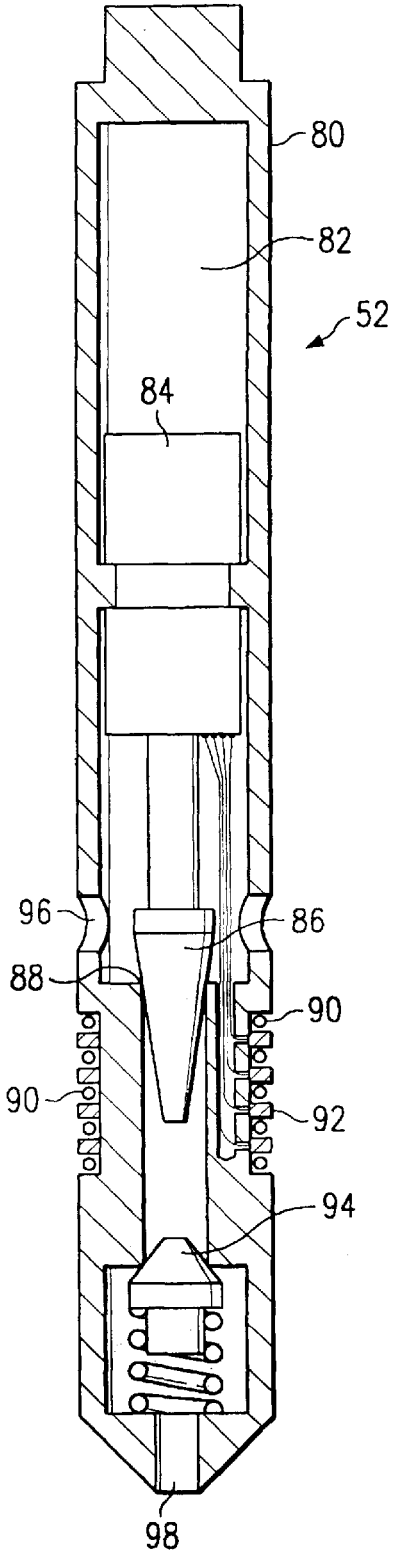
FIG. 2B is a cross-sectional side view of the controllable gas-lift valve of FIG. 2A taken at III—III.

Referring more specifically to FIGS. 2A and 2B, a more detailed illustration of controllable gas-lift valve 52 and side pocket mandrel 54 is provided. Side pocket mandrel 54 includes a housing 68 having a gas inlet port 72 and a gas outlet port 74. When controllable valve 52 is in an open position, gas inlet port 72 and gas outlet port 74 provide fluid communication between annular space 31 and an interior of tubing string 26. In a closed position, controllable valve 52 prevents fluid communication between annular space 31 and the interior of tubing string 26. In a plurality of intermediate positions located between the open and closed positions, controllable valve 52 meters the amount of gas flowing from annular space 31 into tubing string 26 through gas inlet port 72 and gas outlet port 74.

Controllable gas-lift valve 52 includes a generally cylindrical, hollow housing 80 configured for reception in side pocket mandrel 54. An electronics module 82 is disposed within housing 80 and is electrically connected to a stepper motor 84 for controlling the operation thereof. Operation of stepper motor 84 adjusts a needle valve head 86, thereby controlling the position of needle valve head 86 in relation to a valve seat 88. Movement of needle valve head 86 by stepper motor 84 directly affects the amount of fluid communication that occurs between annular space 31 and the interior of tubing string 26. When needle valve head 86 fully engages valve seat 88 as shown in FIG. 2B, the controllable valve 52 is in the closed position.

O-rings 90 are made of an elastomeric material and allow controllable valve 52 to sealingly engage side pocket mandrel 54. Slip rings 92 surround a lower portion of housing 80 and are electrically connected to electronics module 82. Slip rings 92 provide an electrical connection for power and communication between tubing string 26 and electronics module 82.

Controllable valve 52 includes a check valve head 94 disposed within housing 80 below needle valve head 86. An inlet 96 and an outlet 98 cooperate with inlet port 72 and outlet port 74 when valve 52 is in the open position to provide fluid communication between annulus 31 and the interior of tubing string 26. Check valve 94 insures that fluid flow only occurs when the pressure of fluid in annulus 31 is greater than the pressure of fluid in the interior of tubing string 26.

Figure 3A:
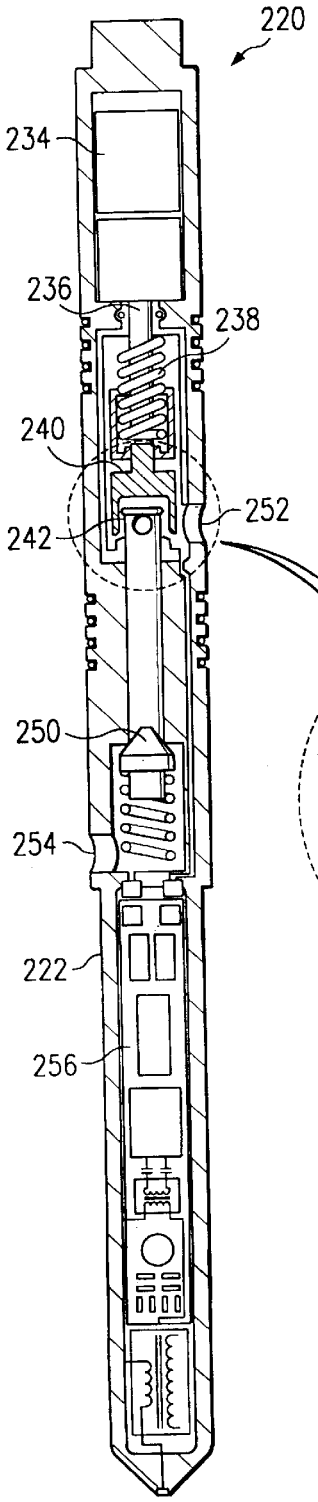
FIGS. 3A–3C are cross-sectional front views of a preferred embodiment of a controllable gas-lift valve in a cage configuration.
Figure 3B:
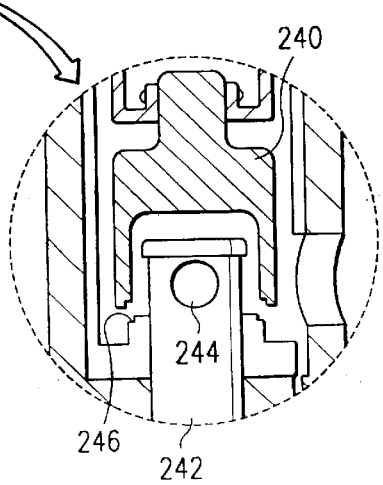
Figure 3C:
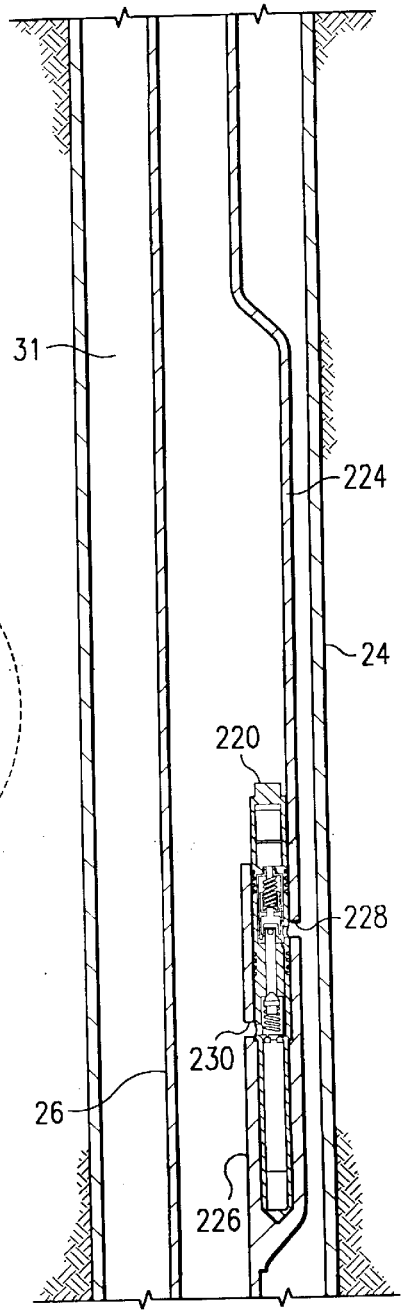

Referring now to FIGS. 3A, 3B, and 3C in the drawings, another embodiment of a controllable valve 220 according to the present invention is illustrated. Controllable valve 220 includes a housing 222 and is slidably received in a side pocket mandrel 224 (similar to side pocket mandrel 54 of FIG. 2A). Side pocket mandrel 224 includes a housing 226 having a gas inlet port 228 and a gas outlet port 230. When controllable valve 220 is in an open position, gas inlet port 228 and gas outlet port 230 provide fluid communication between annular space 31 and an interior of tubing string 26. In a closed position, controllable valve 220 prevents fluid communication between annular space 31 and the interior of tubing string 26. In a plurality of intermediate positions located between the open and closed positions, controllable valve 220 meters the amount of gas flowing from annular space 31 into tubing string 26 through gas inlet port 228 and gas outlet port 230.

A stepper motor 234 is disposed within housing 222 of controllable valve 220 for rotating a pinion 236. Pinion 236 engages a worm gear 238, which in turn raises and lowers a cage 240. When valve 220 is in the closed position, cage 240 engages a seat 242 to prevent flow into an orifice 244, thereby preventing flow through valve 220. As shown in more detail in FIG. 3B, a shoulder 246 on seat 242 is configured to sealingly engage a mating collar on cage 240 when the valve is closed. This "cage" valve configuration is believed to be a preferable design from a fluid mechanics view when compared to the alternative embodiment of a needle valve configuration (see FIG. 2B). More specifically, fluid flow from inlet port 228, past the cage and seat juncture (240, 242) permits precise fluid regulation without undue fluid wear on the mechanical interfaces.

Controllable valve 220 includes a check valve head 250 disposed within housing 222 below cage 240. An inlet 252 and an outlet 254 cooperate with gas inlet port 228 and gas outlet port 230 when valve 220 is in the open position to provide fluid communication between annulus 31 and the interior of tubing string 26. Check valve head 250 insures that fluid flow only occurs when the pressure of fluid in annulus 31 is greater than the pressure of fluid in the interior of tubing string 26.

An electronics module 256 is disposed within the housing of controllable valve 220. The electronics module is operatively connected to valve 220 for communication between the surface of the well and the valve. In addition to sending signals to the surface to communicate downhole physical conditions, the electronics module can receive instructions from the surface and adjust the operational characteristics of the valve 220.

Figure 4:
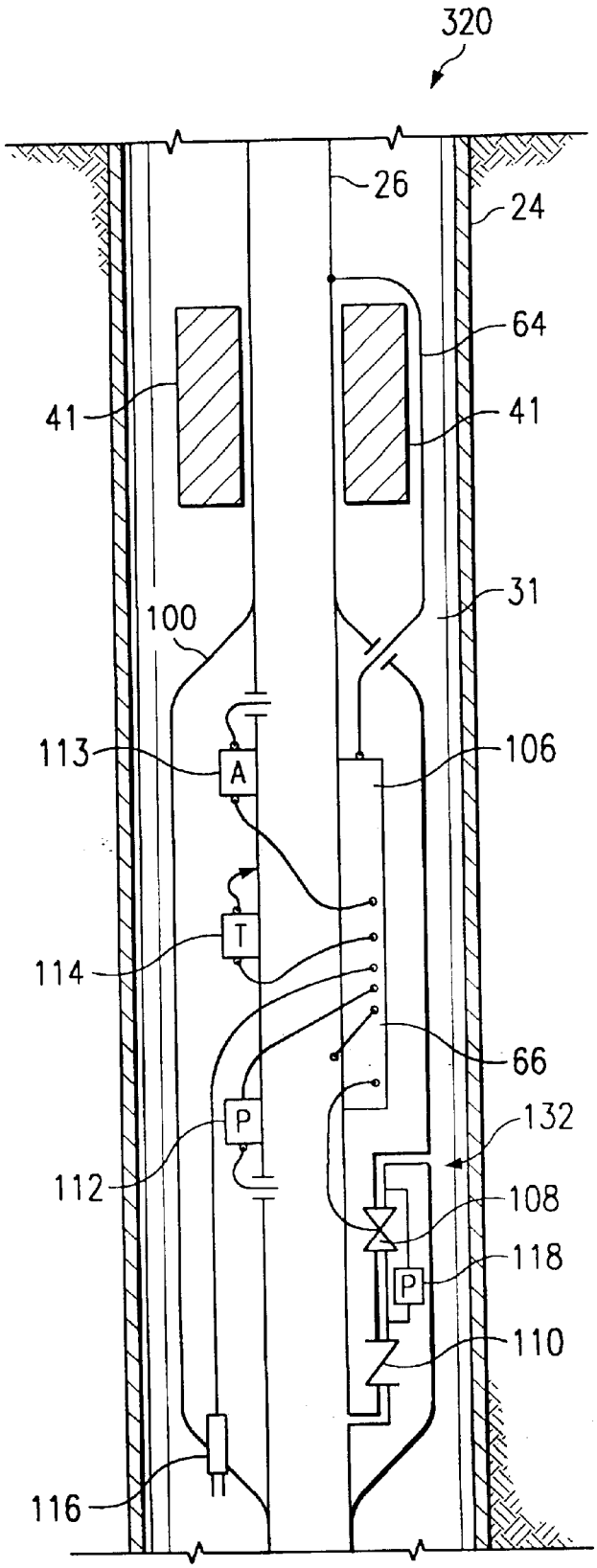
FIG. 4 is an enlarged schematic front view of the tubing string and casing of FIG. 1, the tubing string having an electronics module and sensors coupled to the tubing string separate from a controllable gas-lift valve.

Referring to FIG. 4 in the drawings, an alternative installation configuration for a controllable valve 132 is shown and should be contrasted with the side pocket mandrel configuration of FIG. 2A. In FIG. 4, tubing string 26 includes an annularly enlarged pocket, or pod 100 formed on the exterior of tubing string 26. Enlarged pocket 100 includes a housing that surrounds and protects controllable gas-lift valve 132 and an electronics module 106. In this mounting configuration, gas-lift valve 132 is rigidly mounted to tubing string 26 and is not insertable and retrievable by wireline. Module 106 is energized by the electrical potential developed on the tubing 26 by the action of choke 41. This potential difference is made available to module 106 by connectors 64 (above choke) and 66 (below choke), as is also indicated in FIG. 1 Electronics module 106 is rigidly connected to tubing string 26 thus in this configuration is not insertable or retrievable by wireline.

Controllable valve 132 includes a motorized cage valve 108 and a check valve 110 that are schematically illustrated in FIG. 4. Cage valve 108 and check valve 110 operate in a similar fashion to cage 240 and check valve head 250 of FIG. 3A. The valves 108, 110 cooperate to control fluid communication between annular space 31 and the interior of tubing string 26.

A plurality of sensors are used in conjunction with electronics module 106 to control the operation of controllable valve 132 and gas-lift well 320. In the preferred embodiment at least one acoustic sensor 113 is mounted to tubing string 26 to sense the internal acoustic signature of fluid flow through tubing string 26. Acoustic sensor 113 is electrically coupled to electronics module 106 for communication and power. By determining the acoustic signature of the fluid, a flow regime can be identified and adjustments can be made to optimize the fluid flow. In some cases, it may be necessary to vary the well's lift operating parameters to bring a flow regime to its desired value.

Pressure sensors, such as those produced by Three Measurement Specialties, Inc., can be used to measure internal tubing pressure, internal pod housing pressures, and differential pressures across gas-lift valves. In commercial operation, the internal pod pressure is considered unnecessary. A pressure sensor 112 is rigidly mounted within enlarged pocket 100 to sense the internal tubing pressure of fluid within tubing string 26. A pressure sensor 118 is mounted within pocket 100 to determine the differential pressure across cage valve 108. Both pressure sensor 112 and pressure sensor 118 are independently electrically coupled to electronics module 106 for receiving power and for relaying communications. Pressure sensors 112, 118 are potted to withstand the severe vibration associated with gas-lift tubing strings.

Temperature sensors, such as those manufactured by Four Analog Devices, Inc. (e.g. LM-34), are used to measure the temperature of fluid within the tubing, housing pod, power transformer, or power supply. A temperature sensor 114 is mounted to tubing string 26 to sense the internal temperature of fluid within tubing string 26. Temperature sensor 114 is electrically coupled to electronics module 106 for receiving power and for relaying communications. The temperature transducers used downhole are rated for −50 to 300° F. and are conditioned by input circuitry to +5 to +255° F. The raw voltage developed at a power supply in electronics module 106 is divided in a resistive divider element so that 25.5 volts will produce an input to the analog/digital converter of 5 volts.

A salinity sensor 116 is also electrically connected to electronics module 106. Salinity sensor 116 is rigidly and sealingly connected to the housing of enlarged pocket 100 to sense the salinity of the fluid in annulus 31.

It should be understood that the alternate embodiments illustrated in FIGS. 2A, 3C and 4 could include or exclude any number of the sensors 112, 113, 114, 116 or 118. In each embodiment of the present invention, it is preferred that at least one acoustic sensor 113 be used to determine the flow regime of fluid within the tubing string. Sensors other than those displayed in FIG. 4 could also be employed in each of the various embodiments. These could include gauge pressure sensors, absolute pressure sensors, differential pressure sensors, flow rate sensors, tubing acoustic wave sensors, valve position sensors, or a variety of other analog signal sensors. Similarly, it should be noted that while electronics module 82 shown in FIG. 2B is packaged within valve 52, and electronics module 256 in FIG. 3A is packaged within valve 220, an electronics module similar to electronics module 106 could be packaged with various sensors and deployed independently of the controllable valve.

Figure 5A:
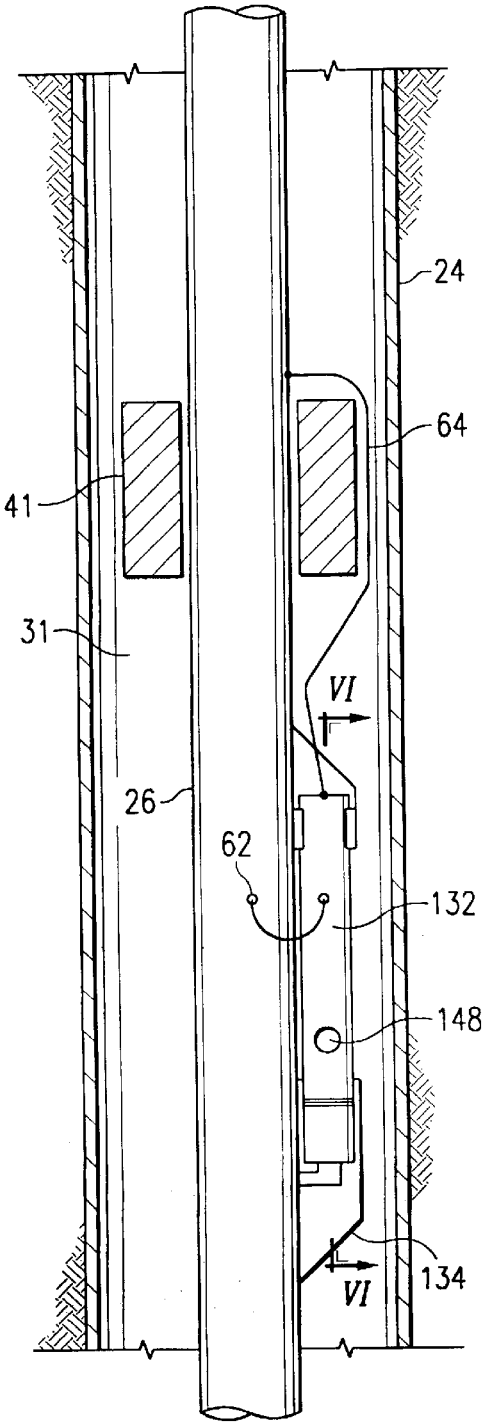
FIG. 5A is an enlarged schematic front view of the tubing string and casing of FIG. 1, the tubing string having a controllable gas-lift valve permanently connected to the tubing string.
Figure 5B:
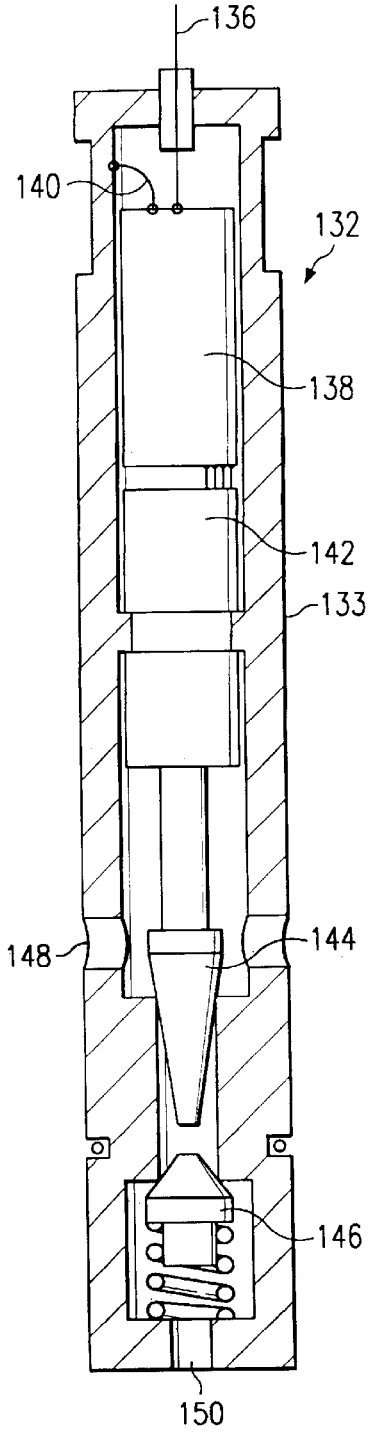
FIG. 5B is a cross-sectional side view of the controllable gas-lift valve of FIG. 5A taken at VI—VI.

Referring to FIGS. 5A and 5B in the drawings, a controllable gas-lift valve 132 having a valve housing 133 is mounted on a tubing conveyed mandrel 134. Controllable valve 132 is mounted similar to most of the bellows-type gas-lift valves that are in use today. These valves are not wireline replaceable, and must be replaced by pulling tubing string 26. An electronics module 138 is mounted within housing 133 above a stepper motor 142 that drives a needle valve head 144. A check valve 146 is disposed within housing 133 below needle valve head 144. Stepper motor 142, needle valve head 144, and check valve 146 are similar in operation and configuration to those used in controllable valve 52 depicted in FIG. 2B. It should be understood, however, that valve 132 could include a cage configuration (as opposed to the needle valve configuration) similar to valve 220 of FIG. 3A. In similar fashion to FIG. 2B, an inlet 148 and an outlet 150 allow fluid communication between annulus 31 and the interior of tubing string 26 when valve 132 is in an open position.

Power and communication are supplied to electronics module 138 by a power and signal connectors 62 and 64 connected above and below choke 41, in a similar manner to that described in reference to FIGS. 2A and 4.

Although not specifically shown in the drawings, electronics module 138 could have any number of sensors electrically coupled to the module 138 for sensing downhole conditions. These could include pressure sensors, temperature sensors, salinity sensors, flow rate sensors, tubing acoustic wave sensors, valve position sensors, or a variety of other analog signal sensors. These sensors would be connected in a manner similar to that used for sensors 112, 113, 114, 116, and 118 of FIG. 4.

Figure 6:
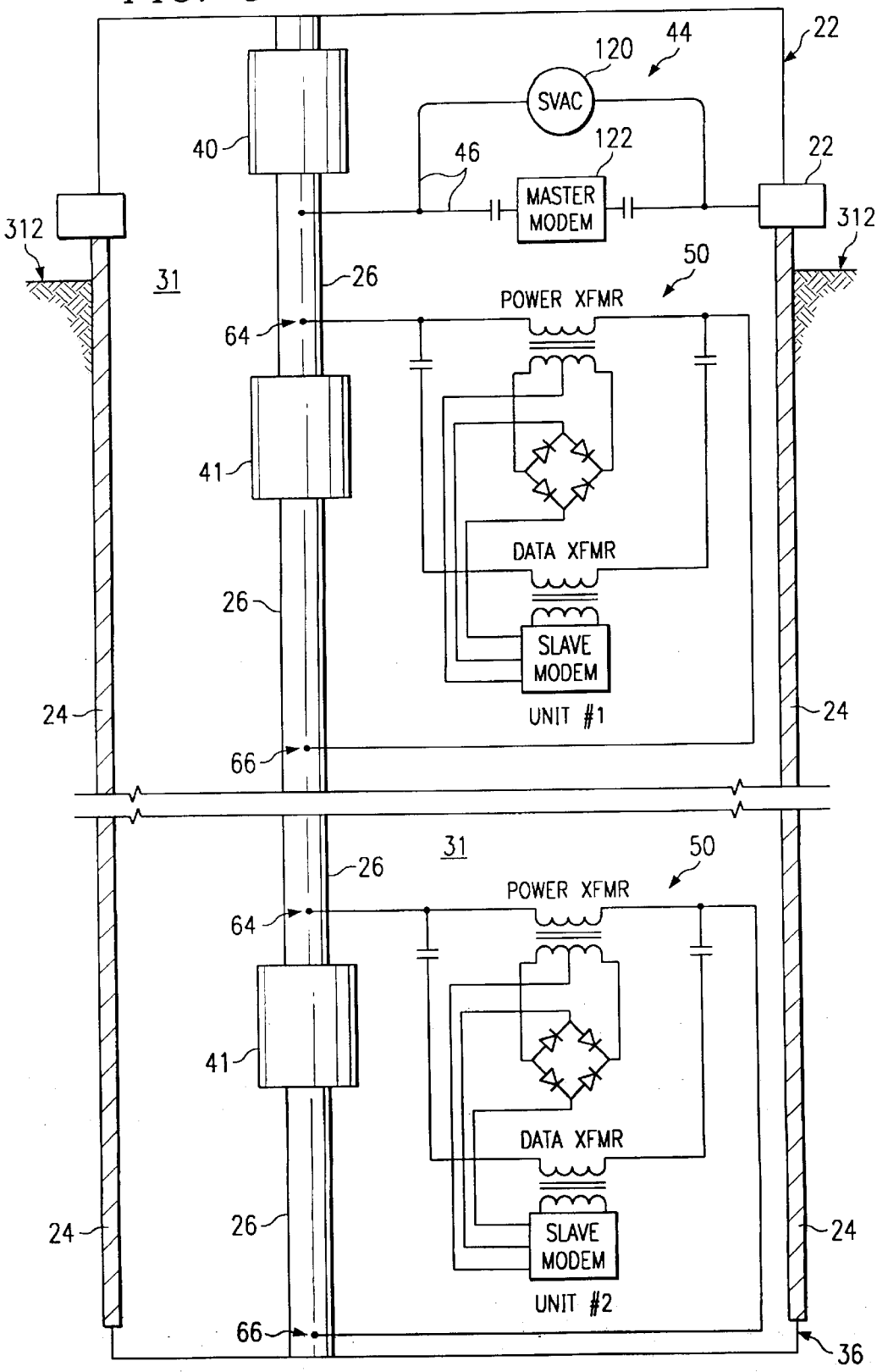
FIG. 6 is a schematic of an equivalent circuit diagram for the controllable gas-lift well of FIG. 1, the gas-lift well having an AC power source, the electronics module of FIG. 2A, and the electronics module of FIG. 4.

Referring now to FIG. 6 in the drawings, an equivalent circuit diagram for gas-lift well 10 is illustrated and should be compared to FIG. 1. Computer and power source 44 includes an AC power source 120 and a master modem 122 electrically connected between casing 24 and tubing string 26. As discussed previously, electronics module 82 is mounted internally within a valve housing that is wireline insertable and retrievable downhole. Electronics module 106 is independently and permanently mounted in an enlarged pocket on tubing string 26. Although not shown, the equivalent circuit diagram could also include depictions of electronics module 256 of FIG. 3A or electronic module 138 of FIG. 5B.

For purposes of the equivalent circuit diagram of FIG. 6, it is important to note that while electronics modules 50 appear identical, each may contain or omit different components and combinations such as sensors 112, 113, 114, 116, 118. Additionally, the electronics modules may or may not be an integral part of the controllable valve. Each electronics module includes a power transformer and a data transformer. The power transformer output is rectified to DC by a full-wave diode bridge. The data transformer is capacitively coupled to a slave modem 130 and couple both input and output signals from the tubing to the receiver and from the transmitter of the modem.

Figure 7:
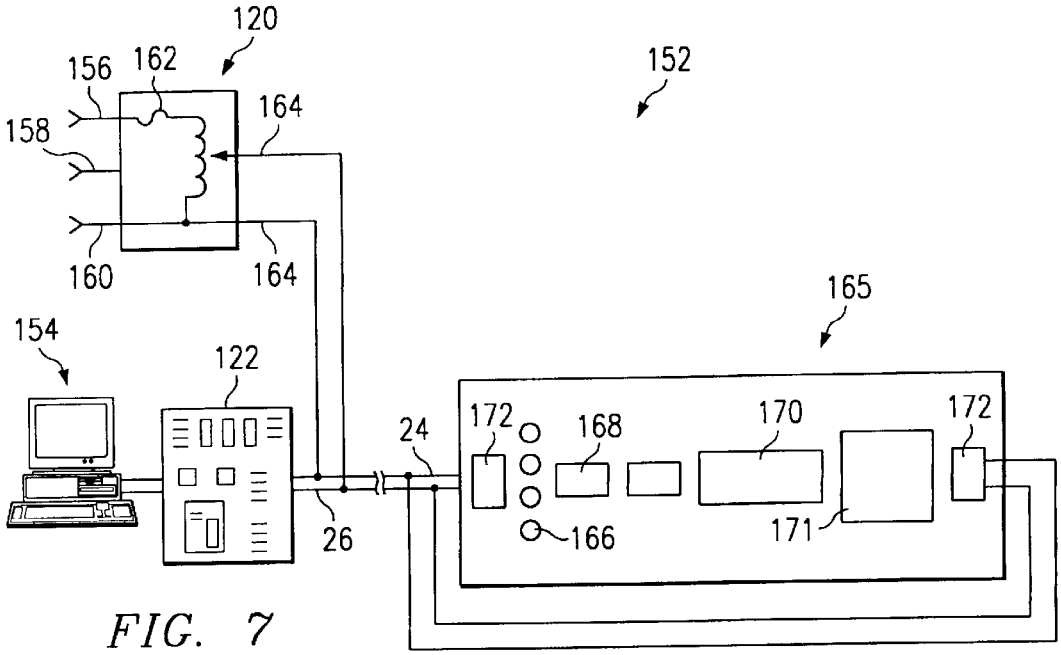
FIG. 7 is a schematic diagram depicting a surface computer electrically coupled to an electronics module of the gas-lift well of FIG. 1.

Referring to FIG. 7 in the drawings, a block diagram of a communications system 152 according to the present invention is illustrated. FIG. 7 should be compared and contrasted with FIGS. 1 and 6. Communications system 152 includes master modem 122, AC power source 120, and a computer 154. Computer 154 is coupled to master modem 122, preferably via an RS232 bus, and runs a multitasking operating system such as Windows NT and a variety of user applications. AC power source 120 includes a 120 volt AC input 156, a ground 158, and a neutral 160 as illustrated. Power source 120 also includes a fuse 162, preferably 7.5 amp, and has a transformer output 164 at approximately 6 volts AC and 60 Hz. Power source 120 and master modem 122 are both connected to casing 24 and tubing 26.

Communications system 152 includes an electronics module 165 that is analogous to module 82 in FIG. 2B, module 256 in FIG. 3A, module 106 in FIG. 3, and module 138 in FIG. 5B. Electronics module 165 includes a power supply 166 and an analog-to-digital conversion module 168. A programmable interface controller (PIC) 170 is electrically coupled to a slave modem 171 (analogous to slave modem 130 of FIG. 6). Couplings 172 are provided for coupling electronics module 165 to casing 24 and tubing 26.

Figure 8:
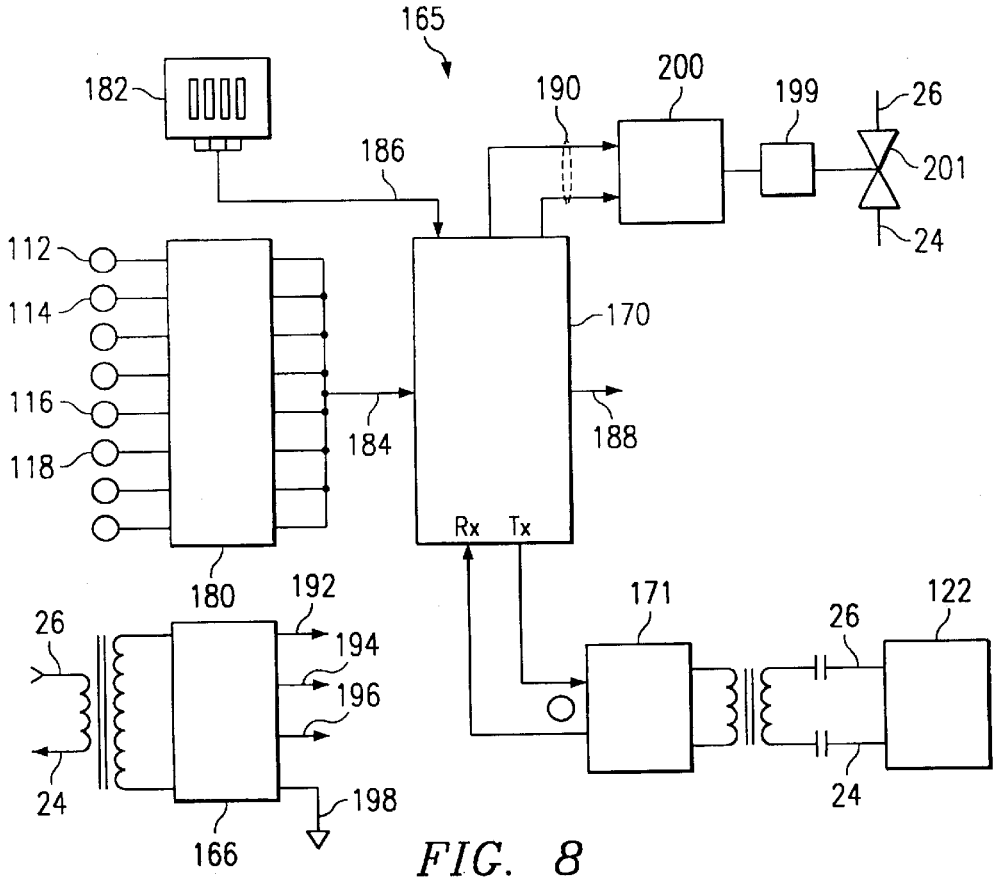
FIG. 8 is a system block diagram of the electronics module of FIG. 7.

Referring to FIG. 8 in the drawings, electronics module 165 is illustrated in more detail. Amplifiers and signal conditioners 180 are provided for receiving inputs from a variety of sensors such as tubing temperature, annulus temperature, tubing pressure, annulus pressure, lift gas flow rate, valve position, salinity, differential pressure, acoustic readings, and others. Some of these sensors are analogous to sensors 112, 113, 114, 116, and 118 shown in FIG. 4. Preferably, any low noise operational amplifiers are configured with non-inverting single ended inputs (e.g. Linear Technology LT1369). All amplifiers 180 are programmed with gain elements designed to convert the operating range of an individual sensor input to a meaningful 8 bit output. For example, one psi of pressure input would produce one bit of digital output, 100 degrees of temperature will produce 100 bits of digital output, and 12.3 volts of raw DC voltage input will produce an output of 123 bits. Amplifiers 180 are capable of rail-to-rail operation.

Electronics module 165 is electrically connected to master modem 122 via casing 24 and tubing string 26. Address switches 182 are provided to address a particular device from master modem 122. As shown in FIG. 8, 4 bits of addresses are switch selectable to form the upper 4 bits of a full 8 bit address. The lower 4 bits are implied and are used to address the individual elements within each electronics module 165. Thus, using the configuration illustrated, sixteen modules are assigned to a single master modem 122 on a single communications line. As configured, up to four master modems 122 can be accommodated on a single communications line.

Electronics module 165 also includes PIC 170, which preferably has a basic clock speed of 20 MHz and is configured with 8 analog-to-digital inputs 184 and 4 address inputs 186. PIC 170 includes a TTL level serial communications UART 188, as well as a stepper motor controller interface 190.

Electronics module 165 also contains a power supply 166. A nominal 6 volts AC line power is supplied to power supply 166 along tubing string 26. Power supply 166 converts this power to plus 5 volts DC at terminal 192, minus 5 volts DC at terminal 194, and plus 6 volts DC at terminal 196. A ground terminal 198 is also shown. The converted power is used by various elements within electronics module 165.

Although connections between power supply 166 and the components of electronics module 165 are not shown, the power supply 166 is electrically coupled to the following components to provide the specified power. PIC 170 uses plus 5 volts DC, while slave modem 171 uses plus 5 and minus 5 volts DC. A stepper motor 199 (analogous to stepper motor 84 of FIG. 2B, stepper motor 234 of FIG. 3A, and stepper motor 142 of FIG. 5B) is supplied with plus 6 volts DC from terminal 196. Power supply 166 comprises a step-up transformer for converting the nominal 6 volts AC to 7.5 volts AC. The 7.5 volts AC is then rectified in a full wave bridge to produce 9.7 volts of unregulated DC current. Three-terminal regulators provide the regulated outputs at terminals 192, 194, and 196 which are heavily filtered and protected by reverse EMF circuitry. Modem 171 is the major power consumer in electronics module 165, typically using 350+ milliamps at plus/minus 5 volts DC when transmitting.

Modem 171 is a digital spread spectrum modem having an IC/SS power line carrier chip set such as models EG ICS1001, ICS1002 and ICS1003 manufactured by National Semiconductor. Modem 171 is capable of 300–3200 baud data rates at carrier frequencies ranging from 14 kHz to 76 kHz. U.S. Pat. No. 5,488,593 describes the chip set in more detail and is incorporated herein by reference. While they are desirable and frequently employed in applications such as this, spread-spectrum communications are not a necessity and other communication methods providing adequate bandwidth would serve equally well.

PIC 170 controls the operation of stepper motor 199 through a stepper motor controller 200 such as model SA1042 manufactured by Motorola. Controller 200 needs only directional information and simple clock pulses from PIC 170 to drive stepper motor 199. An initial setting of controller 200 conditions all elements for initial operation in known states. Stepper motor 199, preferably a MicroMo gear head, positions a Swagelock "vee stem" type needle valve 201 (analogous to needle valve heads 86, 108, and 144 of FIGS. 3B, 5, and 6B, respectively), which is the principal operative component of the controllable gas-lift valve. Alternatively, stepper motor 199 could position a cage analogous to cage 240 of FIG. 4A. Stepper motor 199 provides 0.4 inch-ounce of torque and rotates at up to 500 steps per second. A complete revolution of stepper motor 199 consists of 24 individual steps. The output of stepper motor 199 is directly coupled to a 989:1 gear head which produces the necessary torque to open and close needle valve 201. The continuous rotational torque required to open and close needle valve 201 is 3 inch-pounds with 15 inch-pounds required to seat and unseat the valve 201.

PIC 170 communicates through digital spread spectrum modem 171 to master modem 122 via casing 24 and tubing string 26. PIC 170 uses a MODBUS 584/985 PLC communications protocol. The protocol is ASCII encoded for transmission.

Operation

A large percentage of the artificially lifted oil production today uses gas-lift to help bring the reservoir oil to the surface. In such gas-lift wells, compressed gas is injected downhole outside the tubing string, usually in the annulus between the casing and the tubing string, and mechanical gas-lift valves permit communication of the gas into the tubing string, which causes the fluid column within the tubing string to rise to the surface. Such mechanical gas-lift valves are typically mechanical bellows-type devices that open and close when the fluid pressure exceeds a pre-charge within a bellows section of the valve. Unfortunately, a leak in the bellows is common and renders the bellows-type valve largely inoperative once the bellows pressure departs from its pre-charge setting unless the bellows fails completely, i.e. rupture, in which case the valve fails closed and is totally inoperative. Further, a common source of failure in such bellows-type valve is the erosion and deterioration of the ball valve against the seat as the ball and seat contact frequently during normal operation in the often briny, high temperature, and high pressure conditions downhole. Such leaks and failures are not readily detectable at the surface and probably reduce a well's production efficiency on the order of 15 percent through lower production rates and higher demands on the field lift-gas compression systems.

The controllable gas-lift well 320 of the present invention has a number of data monitoring pods and controllable gas-lift valves on tubing string 26, the number and type of each pod and controllable valve depending on the requirements of the individual well 320. Preferably, at least one acoustic sensor is disposed downhole and is used to determine the flow regime using a trained Artificial Neural Network as shown in FIG. 12. Each of the individual data monitoring pods and controllable valves are individually addressable via the wireless spread spectrum communication through the tubing and casing. More specifically, a master spread spectrum modem at the surface and an associated controller communicate with a number of slave modems downhole. The data monitoring pods report downhole conditions and measurements such as downhole tubing pressures, downhole casing pressures, downhole tubing and casing temperatures, lift gas flow rates, gas valve position, and acoustic data (see FIG. 4, sensors 112, 113, 114, 116, and 118). The data is communicated to the surface through the slave modems via the tubing and casing.

The surface computer 44, which is located either locally or remotely, continuously combines and analyzes the downhole data as well as surface data, to compute a real-time tubing pressure profile. An optimal gas-lift flow rate for each controllable gas-lift valve is computed from this data. Preferably, pressure measurements are taken at locations uninfluenced by gas-lift injection turbulence. Acoustic sensors 113 (sounds less than approximately 20 kilohertz) listen for tubing bubble patterns. Data is sent via the slave modem directly to the surface controller. Alternatively, data can be sent to a mid-hole data monitoring pod and relayed to the surface computer 44. The tubing bubble patterns are analyzed by the Artificial Neural Network of FIG. 12 to determine the flow condition. If flow patterns other than Taylor flow are detected, production control is modified in order to increase the efficiency of production.

More specifically, in addition to controlling the flow rate of the well, production may be controlled to operate in or near the Taylor flow condition. Unwanted conditions such as "heading" and "slug flow" can be avoided. By changing well operating conditions, it is possible to attain and maintain Taylor flow, which is the most desirable flow regime. By being able to determine unwanted bubble flow conditions quickly downhole, production can be controlled to avoid such unwanted conditions. A fast detection of such conditions and a fast response by the surface computer can adjust such factors as the position of a controllable gas-lift valve, the gas injection rate, the back pressure on the tubing string at the wellhead, and even the injection of surfactant.

We claim:

1. A method of operating a gas-lift oil well comprising the steps of:

mounting one or more acoustic sensors proximate production tubing in the oil well;

sensing the acoustic signature of multi-phase fluid flow within the production tubing;

electrically isolating a section of the production tubing using an induction choke;

communicating said acoustic signature to a computer using the electrically isolated section of the production tubing;

determining a flow regime of the multi-phase flow using said computer; and controlling the operating parameters of the oil well based on said determination of said flow regime by said computer.

2. The method of claim 1, said controlling step further comprising the step of regulating the amount of compressed lift gas injected into the oil well.

3. The method of claim 1, said controlling step further comprising the step of regulating the amount of compressed lift gas input through a downhole controllable valve into the production tubing.

4. The method of claim 1, said determining step further comprising the step of inputting said acoustic signature into an Artificial Neural Network (ANN).

5. The method of claim 1, said controlling step further comprising the step of adjusting said operating parameters to attain a Taylor flow regime.

6. The method of claim 1, further comprising the step of sensing additional fluid physical characteristics.

7. The method of claim 6, further comprising the step of sensing pressure and temperature of the fluid in the production tubing.

8. The method of claim 1, wherein said computer is a downhole controller and said controlling step comprises regulating a controllable valve based on said controller determination.

9. The method of claim 1, further comprising the step of powering the acoustic sensor using the production tubing as a conductor.

10. The method of claim 1, further comprising:

providing a casing positioned and longitudinally extending within a borehole of the well;

providing the production tubing annularly spaced within the casing;

electrically isolating a section of the production tubing such that a communications path is created along the section of the production tubing; and sending signals along the isolated section of the production tubing to provide communication between the acoustic sensor and the surface computer.

11. The method of claim 1, further comprising:

providing a casing positioned and longitudinally extending within a borehole of the well;

providing the production tubing annularly spaced within the casing;

coupling an upper signal impedance apparatus to the production tubing proximate a surface of the well;

coupling a lower signal impedance apparatus to the production tubing substantially spaced below the surface of the well in the borehole; and sending signals along a section of the production tubing between the upper signal impedance apparatus and the lower signal impedance apparatus to provide communication between the acoustic sensor and the surface computer.

12. The method of claim 11, further comprising:

inputting power to the section of tubing between the upper and lower signal impedance apparatus for powering the acoustic sensor and a downhole controllable gas-lift valve; and wherein said controlling step further comprises the step of regulating the amount of compressed lift gas input through the downhole controllable valve into the production tubing.

13. A gas-lift oil well comprising:

a production tubing for conveying a multi-phase fluid, including oil and lift gas, to a surface of the well;

one or more sensors located downhole proximate the production tubing for sensing a physical parameter of the multi-phase fluid;

a section of the production tubing electrically isolated using an induction choke such that a communications path is created along the section;

a modem operatively coupled to the production tubing for receiving data from the sensor and conveying the data on the production tubing to the surface using the electrically isolated section of the production tubing; and a computer for receiving said data and determining a flow regime of said multi-phase fluid.

14. The well of claim 13, further comprising a throttle for controlling the amount of lift gas injected into the well, the throttle being controlled by said surface computer based on said flow regime.

15. The well of claim 13, wherein:

said sensor is an acoustic sensor; and said computer includes an Artificial Neural Network for determining a flow regime based on measurements from said acoustic sensor.

16. The well of claim 13, further comprising an AC power source coupled to the production tubing for providing power to said sensor.

17. The well of claim 13, further comprising a downhole controllable valve for regulating the amount of lift gas injected into the production tubing.

18. The well of claim 13, further comprising:

an upper signal impedance apparatus coupled to the production tubing proximate the surface of the well and acting as an impedance to current flow along the production tubing;

a lower induction choke coupled to the tubing below the upper signal impedance apparatus and acting as an impedance to current flow along the production tubing; and wherein the modem communicates data along a section of the production tubing between the upper signal impedance apparatus and the lower signal impedance apparatus.

19. A method of controlling multiphase fluid flow in a conduit comprising the steps of:

determining an acoustic signature of the fluid flow along a portion of the conduit;

impeding AC signal flow on the conduit to electrically isolate a section of the conduit;

conveying the acoustic signature to a controller via an AC signal using the isolated section of the conduit as a conductor;

determining a flow regime of said fluid in said portion based on said acoustic signature; and adjusting the amount of at least one of said fluids in said conduit to attain a more desirable flow regime.

20. The method of claim 19, wherein the conduit is production tubing of an oil well and said multiphase fluid includes oil and lift gas injected into the well.

21. The method of claim 20, wherein the desirable flow regime is attained by minimizing the amount of lift gas injected in the well and maximizing the amount of oil produced.

22. The method of claim 19, wherein the controller is a computer having an Artificial Neural Network for determining the flow regime based on said acoustic signature.

23. The method of claim 19, wherein the desirable flow regime approximates Taylor flow.

24. The method of claim 19, said conveying step further comprising the steps of:

coupling a first signal impedance apparatus to the conduit;

coupling a second signal impedance apparatus to the conduit spaced axially apart from the first signal impedance apparatus along the conduit; and sending AC signals representing the acoustic signature to the controller along a section of the conduit between the first signal impedance apparatus and the second signal impedance apparatus.

25. The method of claim 19, including a plurality of acoustic sensors spaced along the conduit, and powering the sensors by applying an AC signal to the conduit.

26. A method of operating a petroleum well having a piping structure disposed in a borehole comprising the steps of:

mounting a plurality of sensors in or proximate the borehole of the petroleum well;

determining a fluid flow characteristic using said sensors;

electrically isolating a section of the piping structure using a current impedance choke;

powering a number of said sensors using said electrically isolated section of the well piping structure as a conductor and applying a time-varying signal to the electrically isolated section of the piping structure;

communicating said fluid flow characteristics using said piping structure as a conductor; and controlling the operating parameters of the petroleum well based on said communicated flow characteristics.

27. The method of claim 26, including communicating said fluid flow characteristics to a surface computer and determining operating parameters of the petroleum well based in part on said fluid flow characteristics.

28. The method of claim 26, including communicating said fluid flow characteristics to a downhole controller and determining operating parameters of the petroleum well based in part on said fluid flow characteristics.

29. The method of claim 27, measuring surface characteristics of the well and communicating said surface characteristics to the surface computer and determining the operating parameters of the petroleum well based in part on said surface characteristics.

30. The method of claim 26, including controlling the operating parameters of the petroleum well by regulating the flow through a controllable valve mounted to the piping structure downhole.

31. The method of claim 26, the well comprising a gas lift well, including controlling the operating parameters of the petroleum well by regulating the input of compressed gas into the well.

32. The method of claim 26, including controlling the operating parameters of the petroleum well by regulating the output of the well through a controllable valve coupled to the piping structure at the surface.

33. The method of claim 26, including determining a fluid flow characteristics by using an acoustic sensor to estimate fluid flow in the piping structure.

34. The method of claim 26, including determining a fluid flow characteristics by using a pressure sensor to estimate fluid pressure in the piping structure.

35. The method of claim 26, wherein the piping structure includes production tubing and the current impedance choke is a ferromagnetic choke coupled to the production tubing.

36. The method of claim 26, wherein the piping structure includes casing and the current impedance choke is a ferromagnetic choke coupled to the casing.

* * * * *